US009031448B2

(12) United States Patent
Asakawa et al.

(10) Patent No.: US 9,031,448 B2
(45) Date of Patent: May 12, 2015

(54) IMAGE FORMING APPARATUS WITH A PARTITION THAT FORMS PART OF A COOLING AIR PATH WHEN A COVER IS CLOSED BUT PERMITS ACCESS TO AN IMAGE FORMING UNIT WHEN THE COVER IS OPEN

(71) Applicant: Kyocera Document Solutions Inc., Osaka-shi, Osaka (JP)

(72) Inventors: Yoshiyuki Asakawa, Osaka (JP); Hiroyuki Tomioka, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 3 days.

(21) Appl. No.: 13/928,614

(22) Filed: Jun. 27, 2013

(65) Prior Publication Data

US 2014/0003833 A1 Jan. 2, 2014

(30) Foreign Application Priority Data

Jun. 28, 2012 (JP) ..... 2012-144949
Aug. 31, 2012 (JP) ..... 2012-191373

(51) Int. Cl.
*G03G 21/20* (2006.01)

(52) U.S. Cl.
CPC ..... *G03G 21/206* (2013.01); *G03G 2221/1645* (2013.01)

(58) Field of Classification Search
CPC ..... G03G 21/20; G03G 2221/1645
USPC ..... 399/92, 98
See application file for complete search history.

(56) References Cited

U.S. PATENT DOCUMENTS

| | | | | |
|---|---|---|---|---|
| 6,308,024 | B1 * | 10/2001 | Nakayama et al. | 399/98 |
| 2006/0120748 | A1 * | 6/2006 | Takehara et al. | 399/92 |
| 2008/0025752 | A1 * | 1/2008 | Suyama et al. | 399/98 |
| 2008/0050145 | A1 | 2/2008 | Hanano | |
| 2012/0107010 | A1 * | 5/2012 | Hata | 399/92 |

FOREIGN PATENT DOCUMENTS

| | | |
|---|---|---|
| JP | 59-136749 | 8/1984 |
| JP | 59-188666 | 10/1984 |
| JP | 02-115870 | 4/1990 |
| JP | 2001-312200 | 11/2001 |
| JP | 2001-318577 | 11/2001 |
| JP | 2009-9074 | 1/2009 |

* cited by examiner

*Primary Examiner* — Rodney Bonnette
(74) *Attorney, Agent, or Firm* — Gerald E. Hespos; Michael J. Porco; Matthew T. Hespos

(57) ABSTRACT

An image forming apparatus has a casing, an opening/closing cover, an exposure device, an image forming unit, an airflow generator, a cooling air path, and a partition member. The partition member is disposed between the exposure device and the image forming unit, and is configured to change a state thereof between a first state and a second state. The first state is such that the partition member constitutes part of the cooling air path when the opening/closing cover is in a closed state. The second state is such that the image forming unit is allowed to be dismounted from an inner space of the casing, while passing between the exposure device and the image forming unit when the opening/closing cover is in an opened state.

16 Claims, 31 Drawing Sheets

IMAGE FORMING APPARATUS WITH A PARTITION THAT FORMS PART OF A COOLING AIR PATH WHEN A COVER IS CLOSED BUT PERMITS ACCESS TO AN IMAGE FORMING UNIT WHEN THE COVER IS OPEN

This application relates to and claims priority from Japanese Patent Application No. 2012-144949 and Japanese Patent Application No. 2012-191373, respectively filed in the Japan Patent Office on Jun. 28, 2012 and Aug. 31, 2012, the entire disclosure of which is incorporated herein by reference.

BACKGROUND

The present disclosure relates to an image forming apparatus for forming an image on a sheet, and more particularly, to an image forming apparatus provided with an exposure device for forming an electrostatic latent image on an image carrier.

Conventionally, there has been known, as an image forming apparatus for forming an image on a sheet, an image forming apparatus provided with an exposure device and a image forming unit including a photosensitive drum and a developing device. The image forming apparatus is configured such that an electrostatic latent image is formed on the photosensitive drum by the exposure device, and the electrostatic latent image is developed into a toner image by the developing device.

The exposure device is provided with a laser diode, and a seal glass having a dust-proof function in a housing. Laser light emitted from the laser diode is guided to a drum surface of the photosensitive drum which is rotated in a sub scanning direction through the transparent seal glass, while being scanned in a main scanning direction.

Further, conventionally, there has been known a technology of generating cooling air in an image forming apparatus for preventing transfer of heat generated in a fixing device to a toner casing such as a developing device. In the case where cooling air is allowed to flow in the image forming apparatus, as disclosed in the above technology, dust or dirt flowing in from the outside of the image forming apparatus may adhere to the seal glass of the exposure device. If dust or dirt adheres to the seal glass in the image forming apparatus, part of laser light may be blocked and the image quality may be degraded. In view of the above, there is disposed a partition wall which restricts a cooling air path between the photosensitive drum and the exposure device.

In view of the above, an object of the present disclosure is to provide a configuration that enables to avoid a likelihood that a partition member for guiding cooling air may obstruct an operation of mounting and dismounting an image forming unit to and from an apparatus body of an image forming apparatus.

SUMMARY

An image forming apparatus according to an aspect of the present disclosure is provided with a casing, an opening/closing cover, an exposure device, an image forming unit, an airflow generator, a cooling air path, and a partition member. The casing is provided with an inner space. The opening/closing cover is mounted on the casing to be openable and closable for opening the inner space to an outside of the image forming apparatus when the opening/closing cover is in an opened state. The exposure device is provided with a laser light source which emits laser light, a housing which houses the laser light source therein and includes an opening for passing the laser light therethrough, and a light transmissive member which is disposed in the housing at such a position as to cover the opening of the housing for transmitting the laser light. The exposure device is disposed in the inner space. The image forming unit is provided with an image carrier onto which the laser light transmitted through the light transmissive member is irradiated. The image forming unit is mounted to a first position facing the exposure device in the inner space, and is allowed to be mounted and dismounted to and from the inner space when the opening/closing cover is in the opened state. The airflow generator generates an airflow in the inner space. The cooling air path guides the airflow between the exposure device and the image forming unit in the inner space. The partition member is disposed between the exposure device and the image forming unit, and is configured to change a state thereof between a first state and a second state. The first state is such that the partition member projects toward the image forming unit mounted to the first position from a side of the exposure device, and constitutes part of the cooling air path when the opening/closing cover is in a closed state. The second state is such that the image forming unit is allowed to be dismounted from the inner space while passing between the exposure device and the image forming unit when the opening/closing cover is in an opened state.

These and other objects, features and advantages of the present disclosure will become more apparent upon reading the following detailed description along with the accompanying drawings.

DETAILED DESCRIPTION

Figure 1:
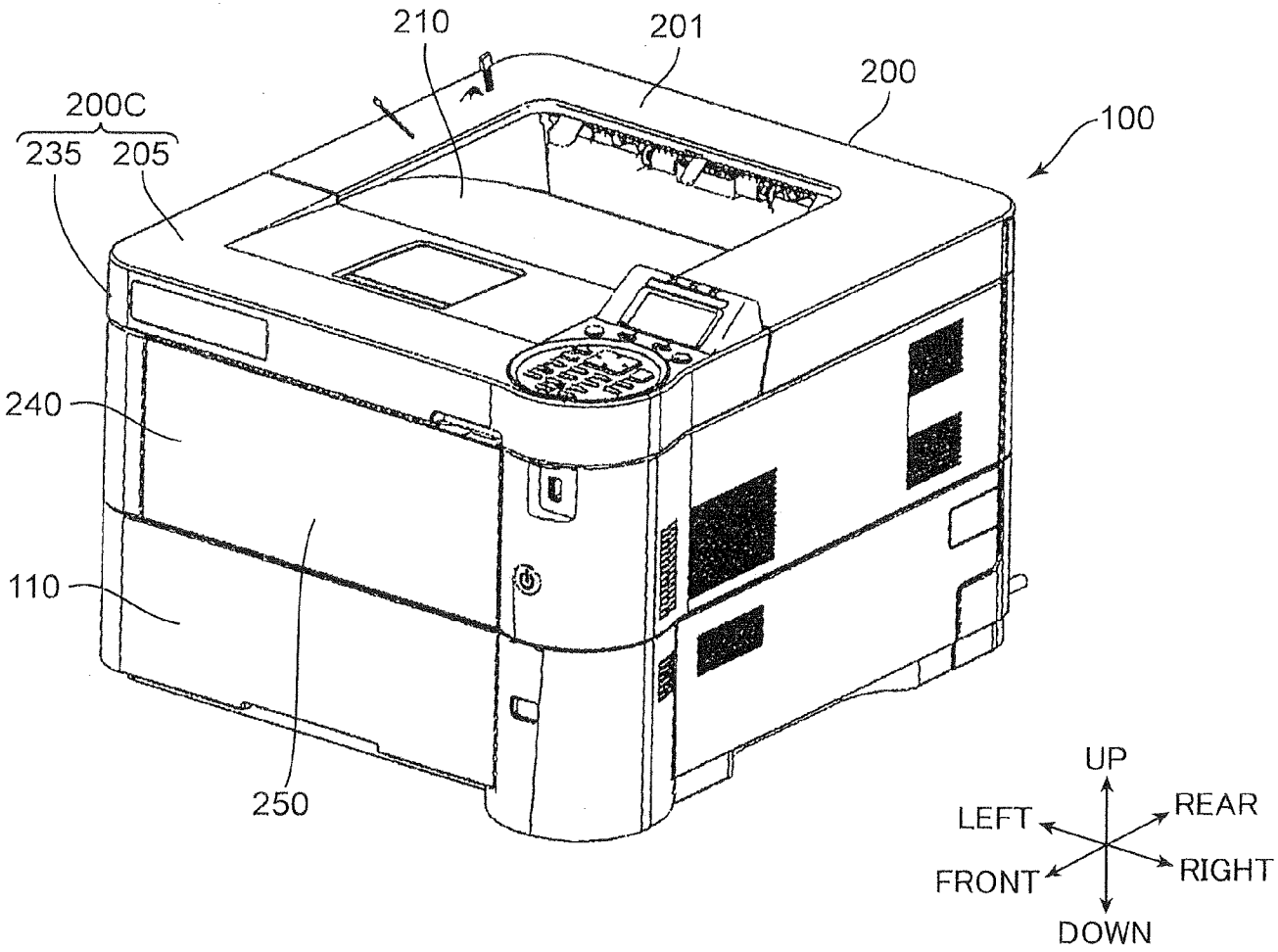
FIG. 1 is a perspective view of an image forming apparatus according to a first embodiment of the present disclosure, and is a diagram showing a state that an opening/closing cover is closed.
Figure 2:
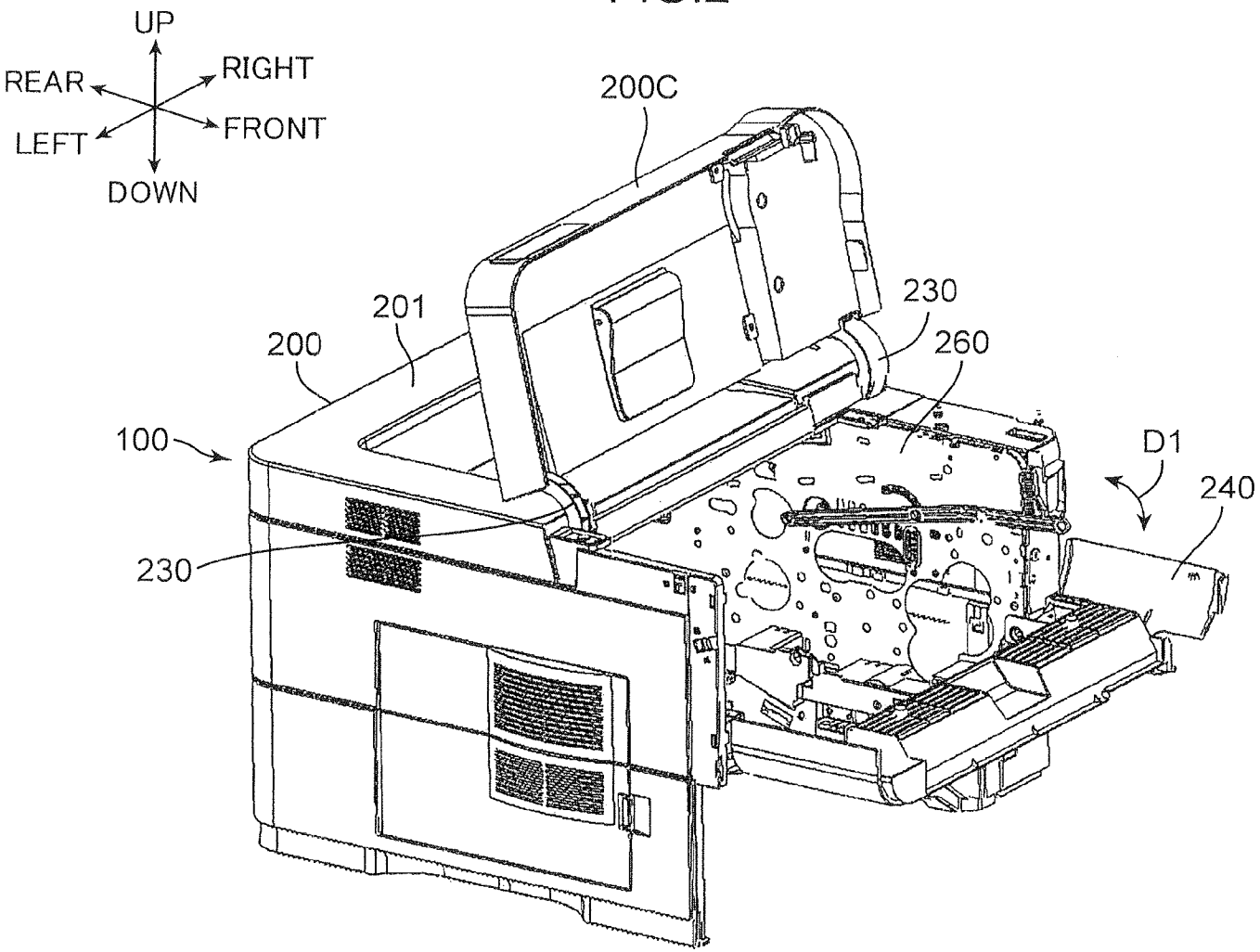
FIG. 2 is a perspective view of the image forming apparatus according to the first embodiment of the present disclosure, and is a diagram showing a state that the opening/closing cover is opened.
Figure 3:
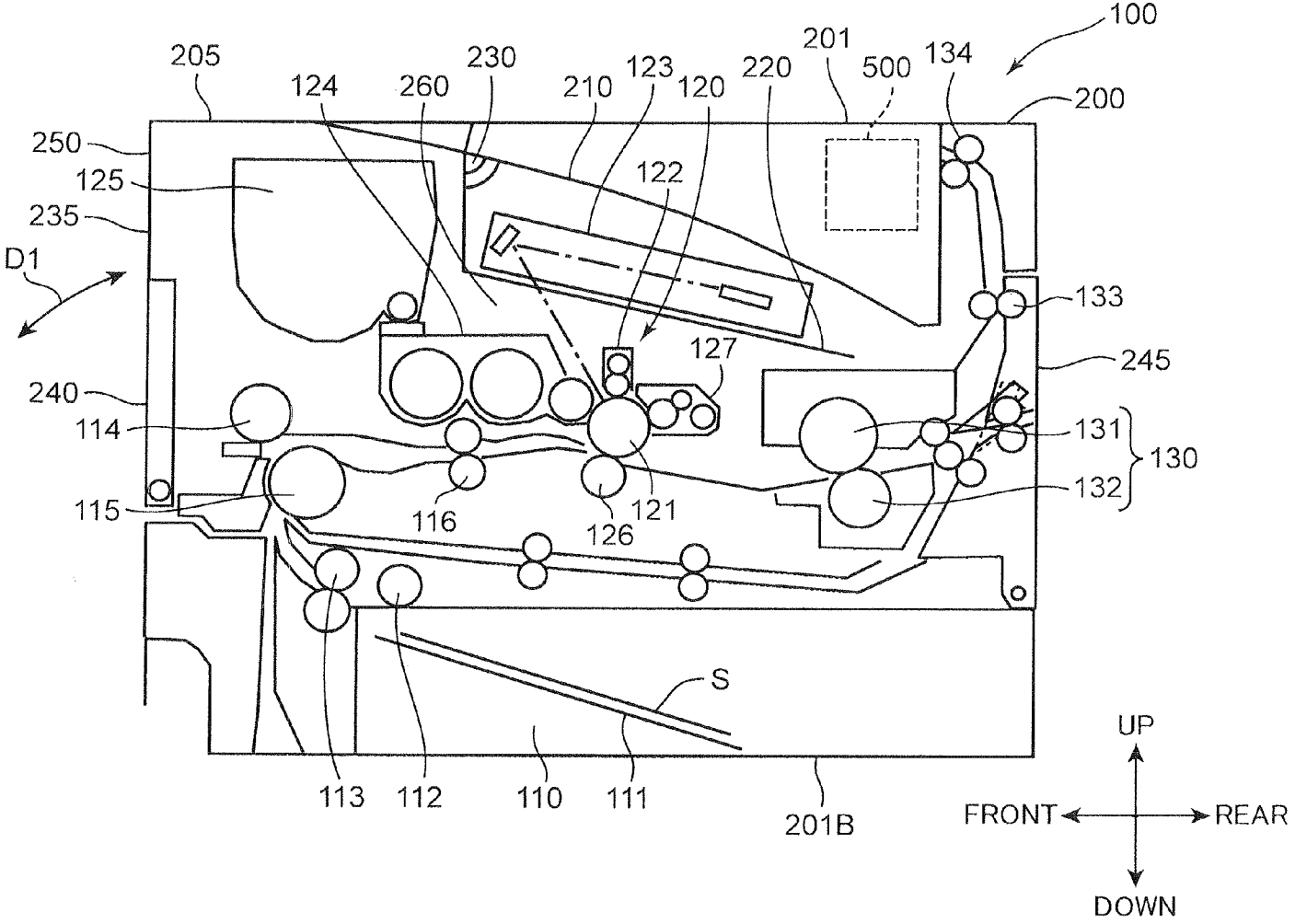
FIG. 3 is a cross sectional view schematically showing an internal structure of the image forming apparatus according to the first embodiment of the present disclosure.

In the following, embodiments of the present disclosure are described in detail referring to the drawings. FIG. 1 is a perspective view of a printer 100 (image forming apparatus) according to a first embodiment of the present disclosure. FIG. 2 is a perspective view of the printer 100 showing a state that an opening/closing cover 200C to be described later is opened upwardly, and a manual tray 240 is opened downwardly. Further, FIG. 2 also shows a state that a cassette 110 to be described later is taken out. Further, FIG. 3 is a cross sectional view schematically showing the internal structure of the printer 100 shown in FIG. 1 and FIG. 2. The printer 100 as an example of the image forming apparatus shown in FIGS. 1 to 3 is a monochromatic printer. Alternatively, the image forming apparatus may be a color printer, a facsimile machine, a complex machine having the functions of these machines, or other devices for forming a toner image on a sheet. The terms indicating the directions such as "up", "down", "front", "rear", "left", and "right" used in the following description are provided simply for clarifying the description, and do not limit the principle of an image forming apparatus in every aspect.

The printer 100 is provided with a casing 200 for housing various devices for forming an image on a sheet S. The casing 200 includes an upper wall 201 defining an upper surface of the casing 200, a bottom wall 201B (see FIG. 3) defining a bottom surface of the casing 200, a back wall 245 (see FIG. 3) between the upper wall 201 and the bottom wall 201B, and a front wall 250 disposed in front of the back wall 245. The casing 200 is provided with a main body inner space 260 (inner space) in which various devices are disposed. Further, the printer 100 is provided with the opening/closing cover 200C, which is mounted to the casing 200 to be openable and closable with respect to the casing 200.

The opening/closing cover 200C is constituted of a front wall upper portion 235 serving as an upper portion of the front wall 250, and an upper wall front potion 205 serving as a front portion of the upper wall 201. Further, the opening/closing cover 200C is openable and closable in up and down directions about the axis of a hinge shaft 232 (see FIG. 15), which is disposed on a pair of arm portions 230 provided at both ends of the opening/closing cover 200C in left and right directions (see FIG. 2 and FIG. 3). When the opening/closing cover 200C is in an opened state, the upper portion of the main body inner space 260 is opened to the outside. On the other hand, when the opening/closing cover 200C is in a closed state, the upper portion of the main body inner space 260 is closed.

A sheet discharge portion 210 is disposed in a middle portion of the upper wall 201. The sheet discharge portion 210 is formed of a downwardly inclined slope in a region from a front portion of the upper wall 201 to a rear portion of the upper wall 201. A sheet S carrying an image thereon is discharged onto the sheet discharge portion 210 in an image forming portion 120 to be described later. Further, the manual tray 240 is disposed at a middle portion of the front wall 250 in up and down directions.

The manual tray 240 is pivotally movable up and down about a lower end thereof (in the directions of arrows D1 shown in FIG. 2 and FIG. 3) as a pivot axis. When the manual tray 240 is in an opened state, the front portion of the main body inner space 260 is opened to the outside. On the other hand, when the manual tray 240 is in a closed state, the front portion of the main body inner space 260 is closed. Specifically, the front portion and the upper portion of the main body inner space 260 are exposed to the outside, as shown in FIG.

2, when both of the opening/closing cover 200C and the manual tray 240 are in an opened state.

Referring to FIG. 3, the printer 100 is provided with the cassette 110, a pickup roller 112, a first feeding roller 113, a second feeding roller 114, a transport roller 115, a registration roller pair 116, and the image forming portion 120.

The cassette 110 accommodates sheets S therein. The cassette 110 is provided with a lifting plate 111 for holding the sheets S thereon. The lifting plate 111 is inclined in such a direction as to push the leading ends of the sheets S upwardly. The cassette 110 defines part of the front wall 250 of the casing 200, and is drawable forwardly with respect to the casing 200.

The pickup roller 112 is disposed at a position above the leading ends of the sheets S lifted upwardly by the lifting plate 111. When the pickup roller 112 is rotated, the sheets S are feeded one by one from the cassette 110.

The first feeding roller 113 is disposed downstream of the pickup roller 112. The first feeding roller 113 is configured to feed a sheet S further downstream. The second feeding roller 114 is disposed on the inner side (rear side) of the pivot axis of the manual tray 240. The second feeding roller 114 is configured to feed a sheet S on the manual tray 240 into the casing 200. The operator is allowed to use a sheet accommodated in the cassette 110 or a sheet placed on the manual tray 240 according to his/her preference.

The transport roller 115 is disposed downstream of the first feeding roller 113 and the second feeding roller 114 in a sheet transport direction (hereinafter, also simply called a transport direction). The transport roller 115 transports a sheet S fed out by the first feeding roller 113 and the second feeding roller 114 further downstream.

The registration roller pair 116 has a function of correcting a skew of a sheet S. By the above operation, the position of an image to be formed on the sheet S is adjusted. The registration roller pair 116 supplies the sheet S to the image forming portion 120 in accordance with a timing of image formation by the image forming portion 120.

The image forming portion 120 is provided with a photosensitive drum 121 (image carrier), a charger 122, an exposure device 123, a developing device 124, a toner container 125, a transfer roller 126 (transfer portion), and a cleaning device 127. Among the devices constituting the image forming portion 120, the photosensitive drum 121, the charger 122, the developing device 124, the toner container 125, and the cleaning device 127 are integrally mountable and dismountable to and from the casing 200, as parts of a process unit 101 (image forming unit) to be described later (see FIG. 20).

The photosensitive drum 121 has a cylindrical shape. The photosensitive drum 121 is configured to form an electrostatic latent image by irradiation of laser light onto the circumferential surface of the photosensitive drum 121 to be described later, and to carry a toner image corresponding to the electrostatic latent image thereon.

The charger 122 is configured to substantially uniformly charge the circumferential surface of the photosensitive drum 121 by application of a predetermined voltage thereto. The charger 122 is disposed between the photosensitive drum 121 and the exposure device 123.

The exposure device 123 irradiates laser light onto the circumferential surface of the photosensitive drum 121 charged by the charger 122. The laser light is irradiated according to image data output from an external device (not shown) such as a personal computer communicatively connected to the printer 100. As a result of the laser light irradiation, an electrostatic latent image corresponding to the image data is formed on the circumferential surface of the photosensitive drum 121. The exposure device 123 will be described later in detail.

The developing device 124 supplies toner to the circumferential surface of the photosensitive drum 121 having an electrostatic latent image formed thereon. The toner container 125 supplies toner to the developing device 124 sequentially or as necessary. When the developing device 124 supplies toner to the photosensitive drum 121, an electrostatic latent image formed on the circumferential surface of the photosensitive drum 121 is developed into a toner image. Thus, the toner image is formed on the circumferential surface of the photosensitive drum 121. The developing device 124 is disposed on the opposite side of the charger 122 with respect to an optical path L of laser light toward the photosensitive drum 121.

The transfer roller 126 is rotatably disposed in such a manner as to contact the circumferential surface of the photosensitive drum 121. When a sheet S transported by the registration roller pair 116 passes between the photosensitive drum 121 and the transfer roller 126, the transfer roller 126 is driven to transfer a toner image formed on the circumferential surface of the photosensitive drum 121 onto the sheet S. The transfer roller 126 is disposed on the opposite side of the exposure device 123 with respect to the photosensitive drum 121.

The cleaning device 127 collects toner remained on the circumferential surface of the photosensitive drum 121 after the toner image is transferred onto the sheet S. The circumferential surface of the photosensitive drum 121 which has undergone a cleaning process by the cleaning device 127 passes below the charger 122, and then, is uniformly charged. Thereafter, formation of a toner image as described above is performed again. The cleaning device 127 is disposed on the opposite side of the developing device 124 with respect to the charger 122.

The printer 100 is further provided with a fixing device 130, on the downstream side of the image forming portion 120 in the transport direction, for fixing a toner image onto a sheet S. The fixing device 130 is provided with a heating roller 131 for fusing toner on the sheet S, and a pressing roller 132 for pressingly contacting the sheet S with the heating roller 131. When a sheet S passes between the heating roller 131 and the pressing roller 132, a toner image is fixed onto the sheet S.

The printer 100 is provided with a transport roller pair 133 disposed downstream of the fixing device 130, and a discharge roller pair 134 disposed downstream of the transport roller pair 133. A sheet S is transported to an upper portion of the printer 100 by the transport roller pair 133, and is finally discharged out of the casing 200 by the discharge roller pair 134. The sheet S discharged out of the casing 200 is placed one over the other on the sheet discharge portion 210.

The printer 100 is further provided with a cooling fan 500 (see FIG. 3). The cooling fan 500 is a rotary fan which is disposed on the inner side of a left wall of the casing 200 (see FIG. 8). An air intake port 501 (see FIG. 9) to be described later is formed in a portion of the left wall of the casing 200 at a position facing the cooling fan 500. The cooling fan 500 generates an airflow. When the cooling fan 500 is rotated by an unillustrated drive motor, air is drawn into the main body inner space 260 through the air intake port 501.

Figure 4:
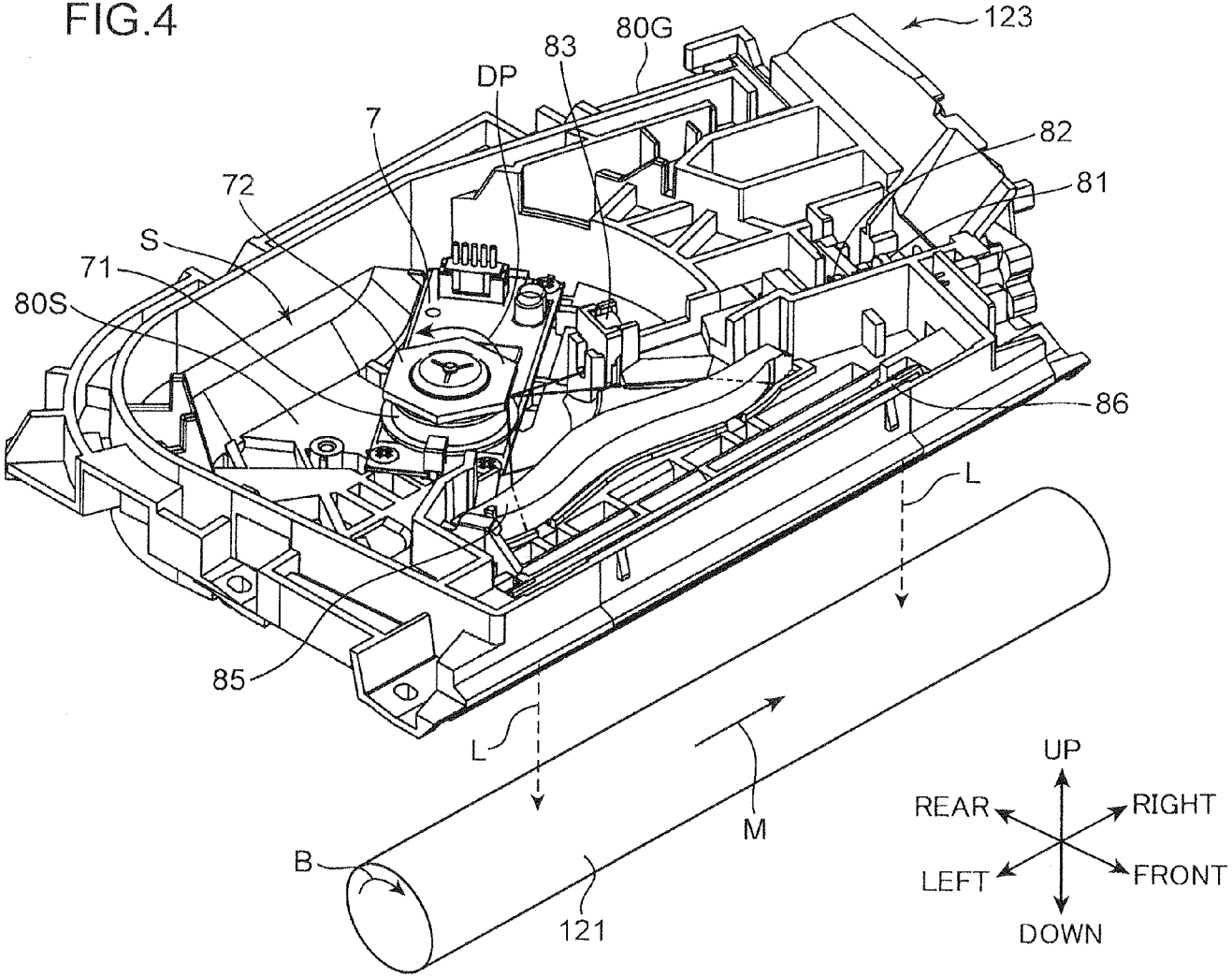
FIG. 4 is an internal perspective view of the exposure device according to the first embodiment of the present disclosure.
Figure 5:
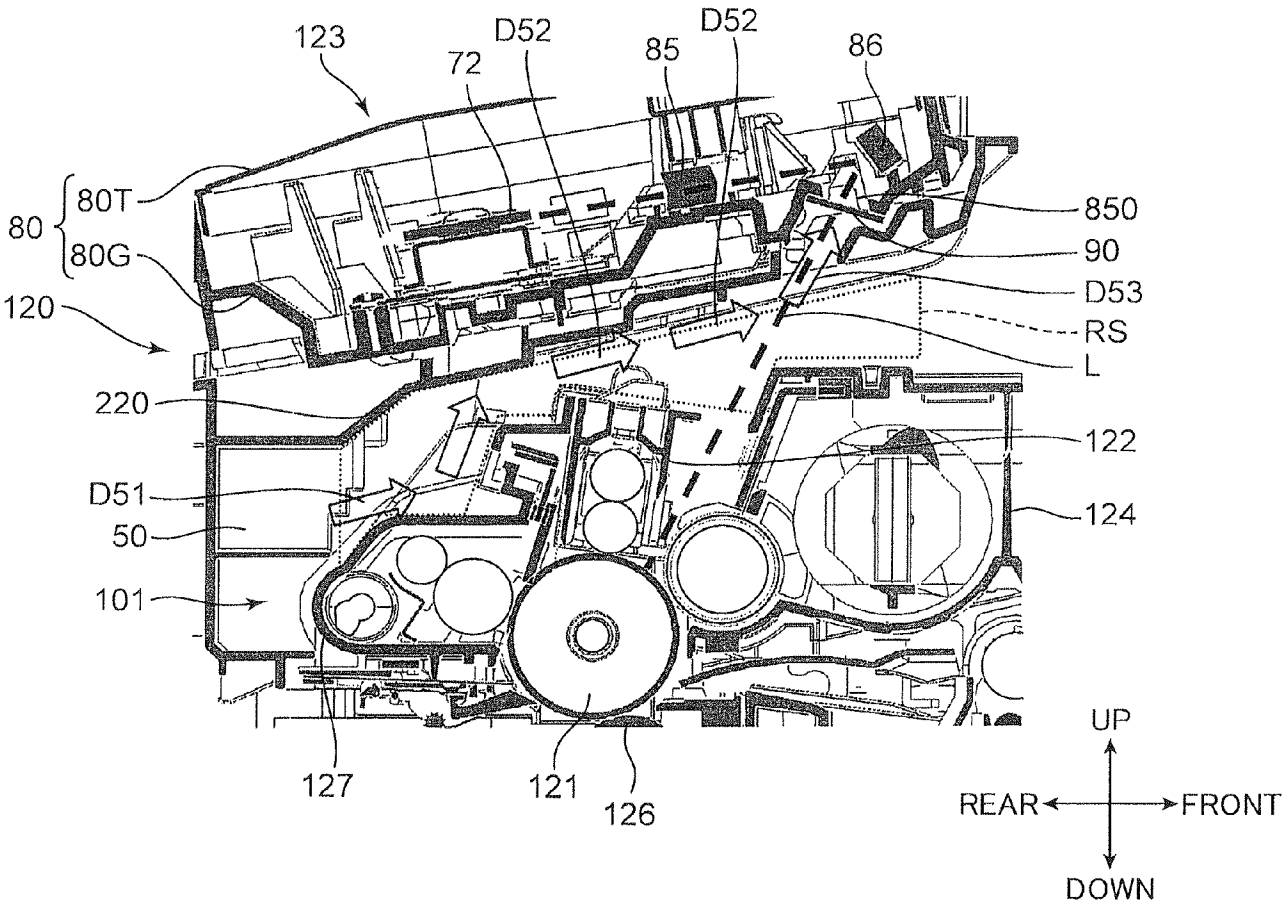
FIG. 5 is a schematic sectional view showing the periphery of an image forming portion for describing a flow of cooling air, in the case where a partition member is not provided in the image forming apparatus according to the first embodiment of the present disclosure.
Figure 6:
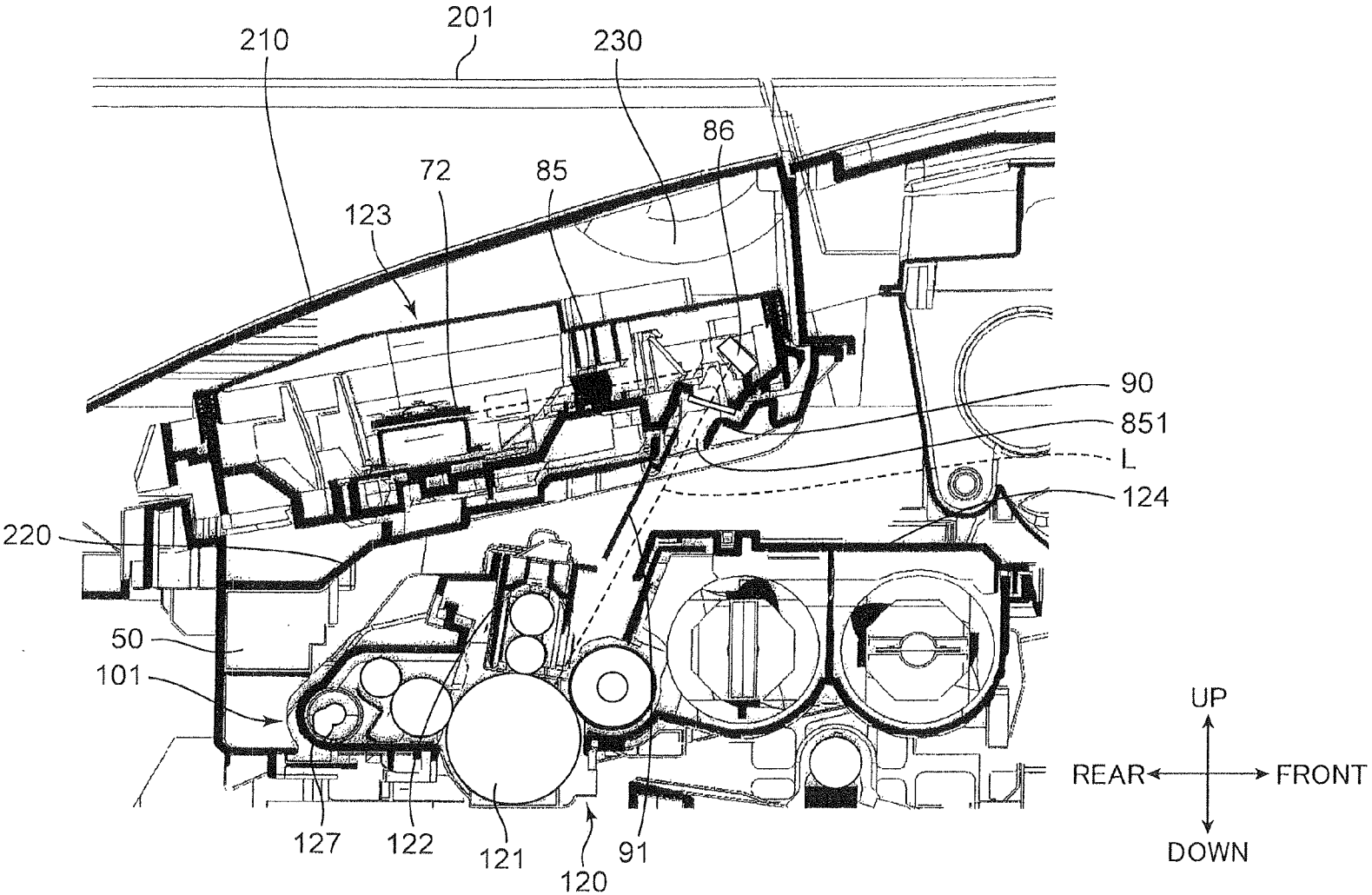
FIG. 6 is a schematic sectional view showing the periphery of the image forming portion for describing a flow of cooling air, in the case where a partition member is provided in the image forming apparatus according to the first embodiment of the present disclosure.
Figure 7:
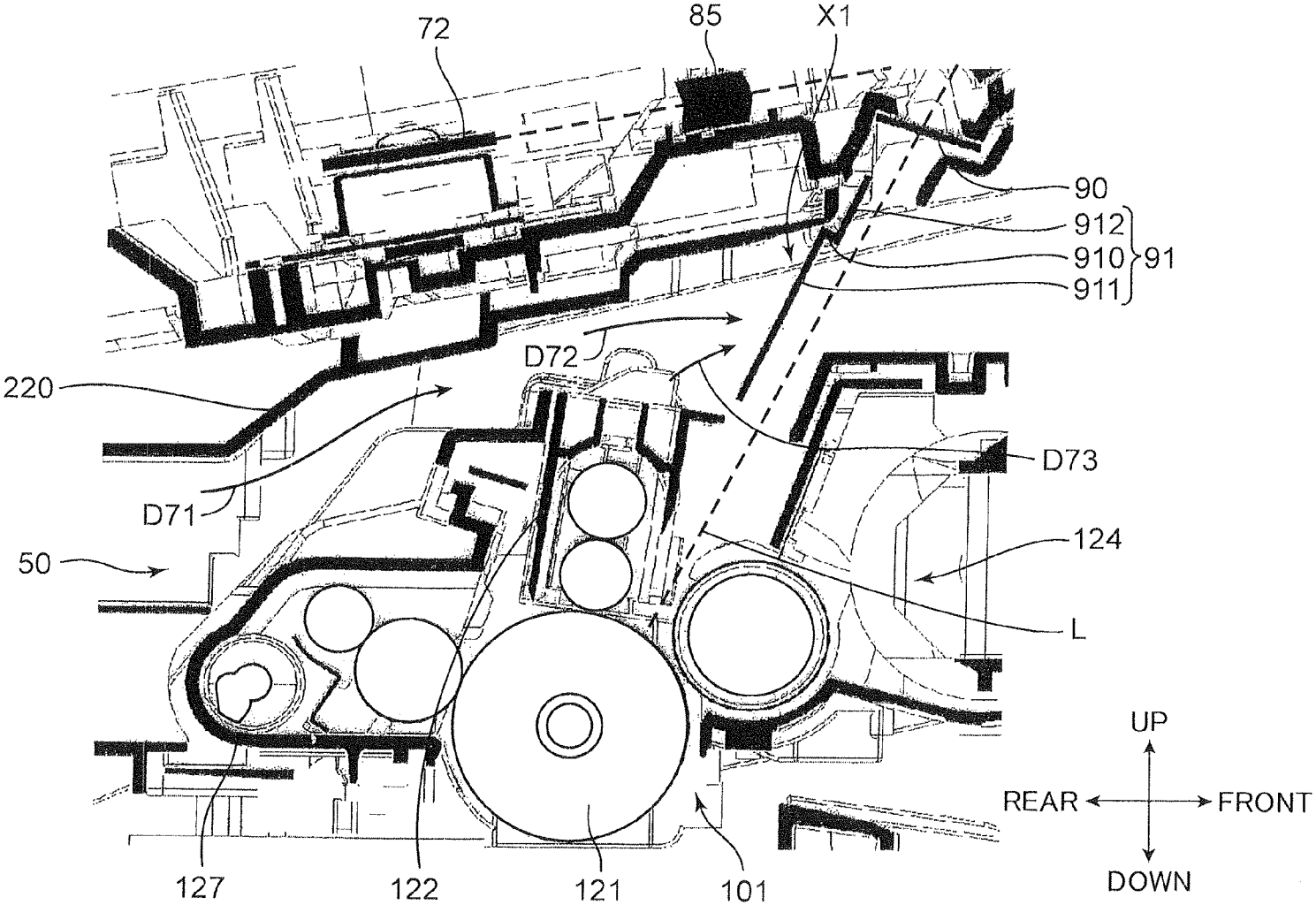
FIG. 7 is an enlarged sectional view of part of FIG. 6.

Next, a configuration of the exposure device 123 in this embodiment is described. FIG. 4 is a perspective view showing an internal structure of the exposure device 123 in this embodiment. FIG. 4 shows a state that a top plate 80T (see FIG. 5) of the exposure device 123 is removed. Further, FIGS. 5 to 7 are cross sectional views enlargedly showing the periphery of the exposure device 123 and the image forming portion 120 in the printer 100. In FIG. 5, the illustration of a blocking member 91 to be described later is omitted.

Referring to FIG. 3, the casing 200 of the printer 100 is provided with an attachment plate 220. The attachment plate 220 is a support plate in the casing 200, and is disposed substantially horizontally at a position below the sheet discharge portion 210. The exposure device 123 is mounted on the upper surface of the attachment plate 220 of the casing 200 in the main body inner space 260.

Referring to FIG. 4, the exposure device 123 is provided with a housing 80 (see FIG. 5), a laser diode 81 (laser light source), lens portions 82 and 83, a polygon motor unit 7, an f lens 85, a reflection mirror 86, and a seal glass 90 (light transmissive member) (see FIG. 5).

The housing 80 is a casing for housing the respective parts of the exposure device 123 therein. The housing 80 is a flat casing in the form of a substantially rectangular shape in top plan view. The housing 80 is provided with a housing body 80G and the top plate 80T. The top plate 80T is mounted to an upper portion of the housing body 80G. An inner space S in which various optical components are disposed is formed in the housing 80. The housing 80 houses the laser diode 81 therein.

The laser diode 81 emits (outputs) laser light according to an image data signal generated and output from an unillustrated image memory. The laser diode 81 is electrically connected to an unillustrated circuit board which controls an emission timing of laser light, for instance. The lens portions 82 and 83 are constituted of a collimator lens and a prism, for instance, and have a function of converting incident laser light into parallel light.

The polygon motor unit 7 is disposed substantially in a middle portion of the housing 80. The polygon motor unit 7 is provided with a polygon motor 71 and a polygon mirror 72 on a substrate. A drive current is input to the polygon motor 71 for rotating the polygon mirror 72 at a predetermined number of rotations. The polygon mirror 72 has the shape of a flat plate with a regular polygonal shape (in FIG. 4, a regular hexagonal shape) in plan view, and is provided with a certain number of mirror surfaces. The polygon mirror 72 is driven and rotated in the direction of the arrow DP in FIG. 4. The polygon mirror 72 deflects the laser light from the lens portion 83, while being rotated by the polygon motor 71, and outputs the deflected light toward the fθ lens 85 for scanning.

The fθ lens 85 extends along left and right directions in front of the polygon motor unit 7. The fθ lens 85 has a substantially arch shape in top plan view. The fθ lens 85 has a function of refracting the laser light deflected by the polygon mirror 72 for scanning the photosensitive drum 121 at a constant speed. The reflection mirror 86 is disposed to reflect the laser light from the fθ lens 85 and to guide the reflected laser light to the photosensitive drum 121.

As shown in FIG. 5, a bottom portion 80S (see FIG. 4) of the housing 80 includes an emission opening portion 850 (opening portion) through which laser light reflected on the reflection mirror 86 is output to the outside of the exposure device 123. The emission opening portion 850 is opened toward the reflection mirror 86 at a position below and behind the reflection mirror 86. The emission opening portion 850 has a predetermined width in front and rear directions, and extends in left and right directions (along the reflection mirror 86).

The seal glass 90 is fixedly mounted to the bottom portion 80S (see FIG. 4) of the housing body 80G in such a manner as to cover the emission opening portion 850 from below. The seal glass 90 is a transparent glass plate, and is configured to transmit laser light transmitted through the emission opening portion 850. Further, the seal glass 90 has a function of preventing intrusion of toner or dust into the exposure device 123. Further, the attachment plate 220 has a passage opening portion 851 (see FIG. 6) for passing the laser light from the emission opening portion 850 toward the photosensitive drum 121.

In the exposure device 123, laser light emitted from the laser diode 81 is guided to the polygon mirror 72 through the lens portions 82 and 83. Then, the laser light incident into the rotating polygon mirror 72 passes the fθ lens 85 after reflecting and deflecting on the mirror surface of the polygon mirror 72, and is reflected on the reflection mirror 86. The laser light reflected on the reflection mirror 86 passes through the emission opening portion 850. Laser light L transmitted through the emission opening portion 850 is transmitted through the seal glass 90, and is guided to the surface of the photosensitive drum 121 which is rotated about the axis of rotation (in the direction of the arrow B in FIG. 4: sub scanning direction) orthogonal to a predetermined scanning direction, while passing through the passage opening portion 851 and horizontally being scanned in the scanning direction (main scanning direction: the direction of the arrow M in FIG. 4).

<Cooling Air Path 50>

Figure 8:
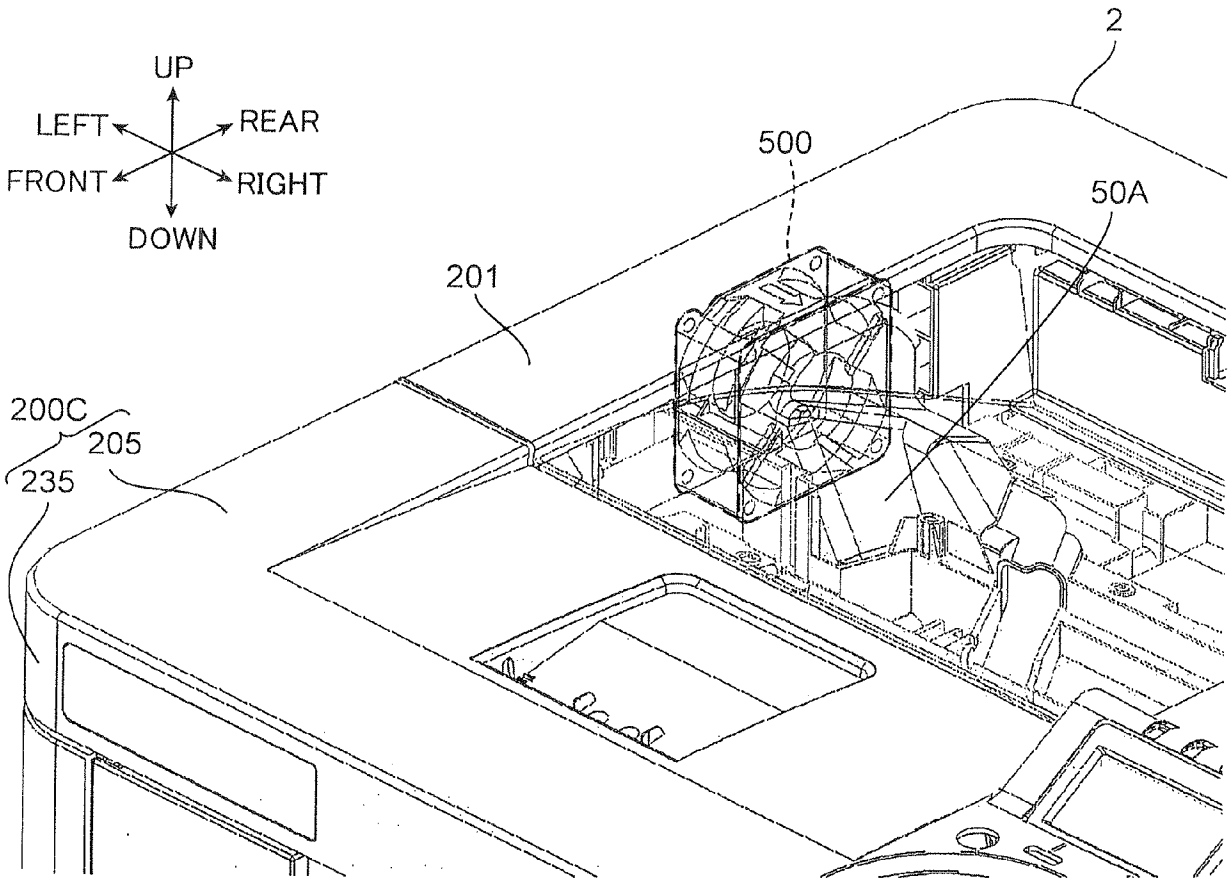
FIG. 8 is a see-through perspective view showing the layout of a cooling fan in the image forming apparatus according to the first embodiment of the present disclosure.
Figure 9:
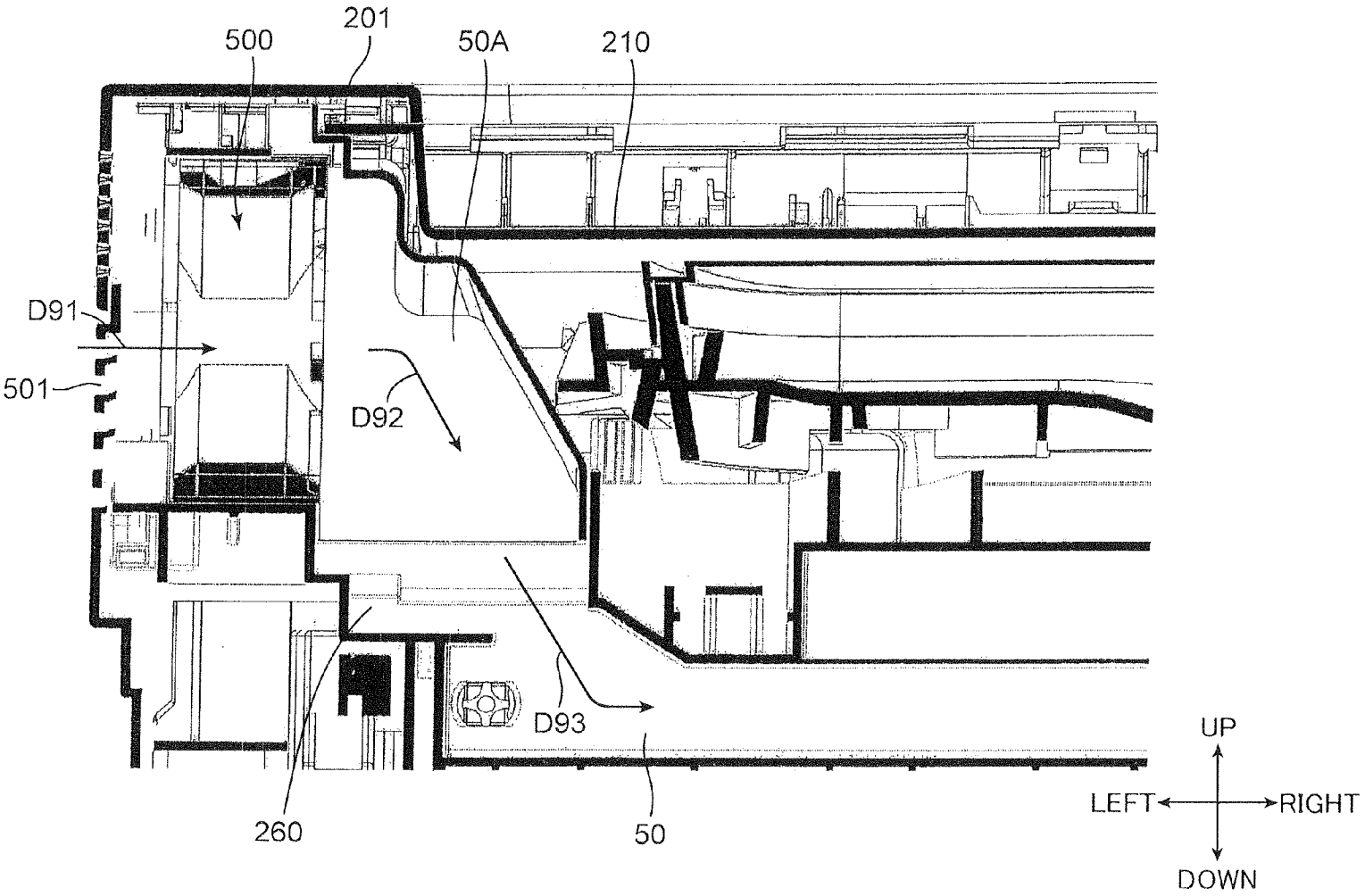
FIG. 9 is a cross sectional view for describing a flow of cooling air in the image forming apparatus according to the first embodiment of the present disclosure.
Figure 10:
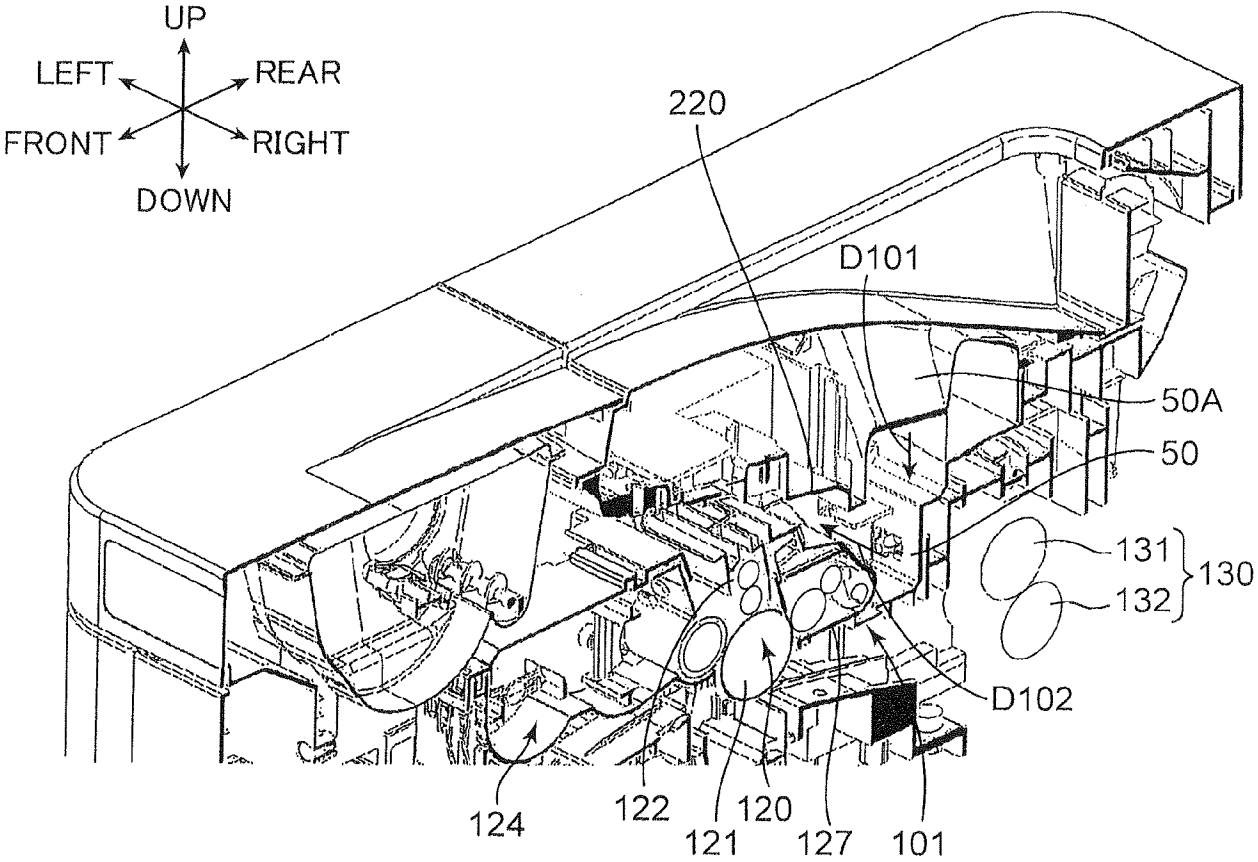
FIG. 10 is a sectional perspective view for describing a flow of cooling air in the image forming apparatus according to the first embodiment of the present disclosure.
Figure 11:
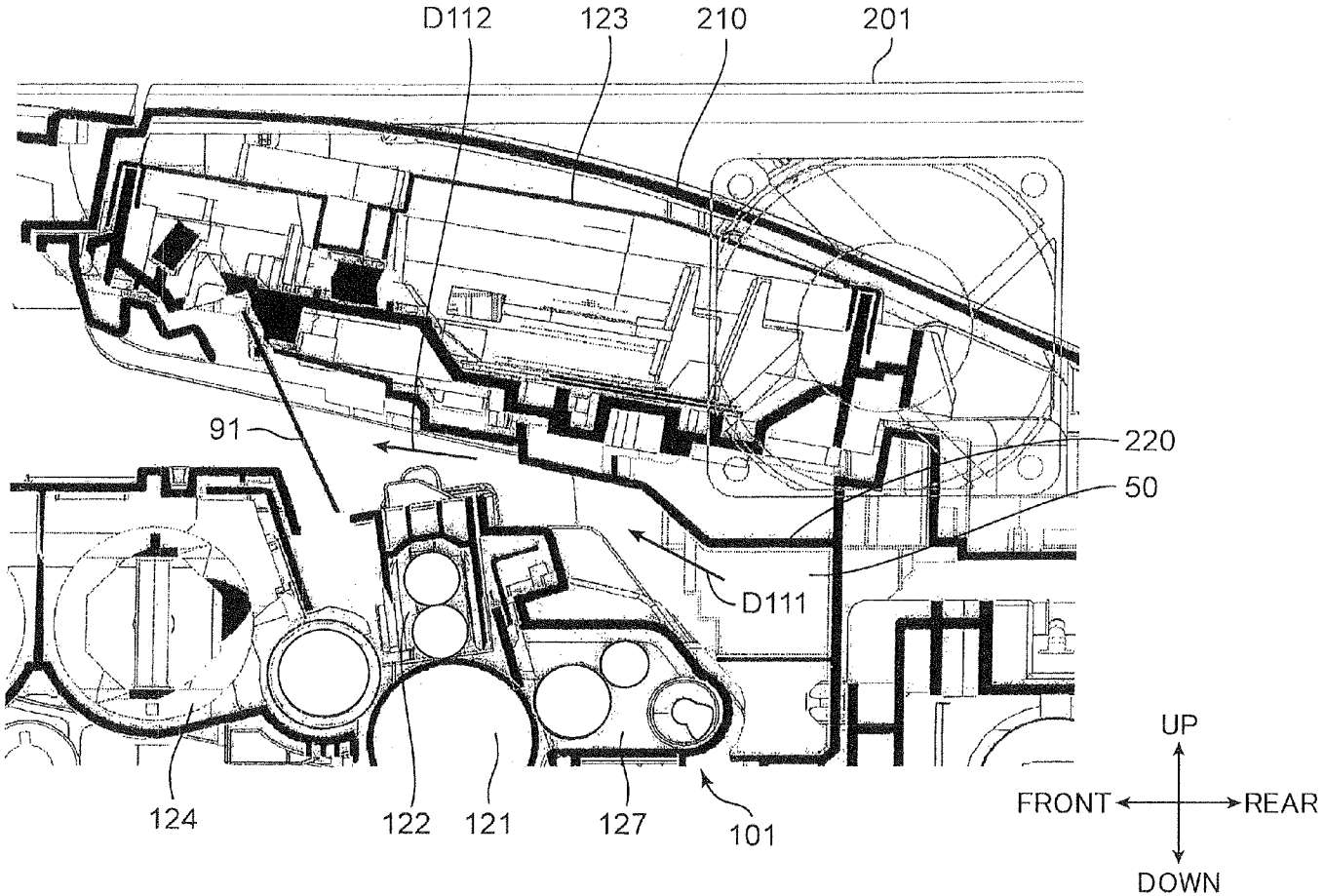
FIG. 11 is a cross sectional view for describing a flow of cooling air in the image forming apparatus according to the first embodiment of the present disclosure.

In this section, the cooling air path 50 to be disposed in the printer 100 according to this embodiment is described referring to FIGS. 8 to 11, in addition to FIGS. 5 to 7. FIG. 8 is a see-through perspective view for describing the layout of the cooling fan 500 in the printer 100 according to this embodiment. Further, FIG. 9 and FIG. 11 are cross sectional views for describing a flow of cooling air in the printer 100. Further, FIG. 10 is a sectional perspective view and a cross sectional view for describing a flow of cooling air in the printer 100.

Referring to FIG. 8 and FIG. 9, the cooling fan 500 is disposed on the inner side of the left wall of the casing 200. The air intake port 501 is formed in the left wall for drawing in an airflow into the main body inner space 260 of the casing 200 (see FIG. 3).

The printer 100 has an air path connecting portion 50A and the cooling air path 50 to be disposed in the main body inner space 260 of the casing 200. The air path connecting portion 50A is a duct which is disposed to face the cooling fan 500 on the inner side (right side) of the cooling fan 500. The air path connecting portion 50A is configured to guide the airflow (indicated by the arrow D91 in FIG. 9) flowing into the main body inner space 260 by the cooling fan 500 rightwardly and downwardly (see the arrow D92 in FIG. 9 and the arrow D101 in FIG. 10).

The cooling air path 50 is a duct to be connected to a lower end of the air path connecting portion 50A. The cooling air path 50 extends in left and right directions in the casing 200. Further, the cooling air path 50 is configured to guide the airflow between the exposure device 123 and the image forming portion 120 (process unit 101). Specifically, the cooling air path 50 is disposed between the attachment plate 220 for supporting the exposure device 123, and the process unit 101 constituting the image forming portion 120 to be described later. The airflow guided by the air path connecting portion 50A is allowed to enter between the exposure device 123 and the image forming portion 120(see the arrow D102 in FIG. 10 and the arrow D111 in FIG. 11), while being guided rightwardly along the cooling air path 50(see the arrow D93 in FIG. 9). Further, the cooling air path 50 is configured to guide the airflow from a position above the cleaning device 127 toward a position above the charger 122 (see the arrow D112 in FIG. 11). In particular, in this embodiment, as shown in FIG. 11, the attachment plate 220 is inclined slightly forwardly from the rear side of the apparatus body. The airflow is guided along a lower wall portion of the attachment plate 220. The periphery of the exposure device 123 and the image forming portion 120 is cooled by the airflow guided by the cooling air path 50 in a satisfactory manner. In particular, in view of a point that toner is adhered to the cleaning device 127 and to the photosensitive drum 121, the aforementioned cooling effect by the airflow makes it possible to prevent toner adhesion and agglomeration on these devices. In particular, it is possible to prevent recycled toner collected in the cleaning device 127 from melting and agglomerating. Further, cooling the exposure device 123 makes it possible to prevent thermal deformation of the optical components disposed in the exposure device 123.

As indicated by the arrows D51, D52, and D53 shown in FIG. 5, when the airflow to be guided by the cooling air path 50 is allowed to flow in from a position above the charger 122 toward a position above the developing device 124, part of the airflow reaches the surface of the seal glass 90. Toner is likely to fly in the periphery of the image forming portion 120. Further, dust may flow into the main body inner space 260 from the outside of the printer 100 by the cooling fan 500. As a result, toner or dust may adhere to the seal glass 90 by the airflow, and part of laser light L to be output through the seal glass 90 may be blocked. This may degrade the image quality.

<Blocking Member 91>

In order to solve the above drawback, in this embodiment, as shown in FIG. 6, FIG. 7, and FIG. 11, a blocking member 91 (partition member) is disposed between the exposure device 123 and the image forming portion 120 (process unit 101). In the following, the blocking member 91 in the first embodiment of the present disclosure is described. The blocking member 91 is disposed between the exposure device 123 and the process unit 101, and is configured to change the state thereof between a first state and a second state. When the blocking member 91 is in the first state, the blocking member 91 projects toward the process unit 101, which is mounted to a first position from the exposure device 123 side, and constitutes part of the cooling air path 50 when the opening/closing cover 200C is in a closed state. When the blocking member 91 is in the second state, the blocking member 91 allows the process unit 101 to be dismounted from the main body inner space 260 when the opening/closing cover 200C is in an opened state.

Specifically, when the blocking member 91 is in a state (first state), in which the process unit 101 of the image forming portion 120 is mounted to a position (first position) facing the transfer roller 126 for image formation in the printer 100, namely, for irradiating laser light transmitted through the seal glass 90 onto the photosensitive drum 121, the blocking member 91 is disposed between the exposure device 123 and the charger 122 in the process unit 101, and constitutes part of the cooling air path 50. The blocking member 91 is a plate-shaped member extending in left and right directions, and is disposed on the lower wall portion of the attachment plate 220 in such a manner as to project toward the process unit 101. Specifically, the blocking member 91 extends, between the charger 122 and the exposure device 123, toward the entrance side (rear side) of the cooling air path 50 than the optical path L in such a manner as to extend along the optical path L of laser light to be output through the seal glass 90. The position of the blocking member 91 in the above state is defined as a projecting position X1 (see FIG. 7).

Disposing the blocking member 91 at the projecting position X1 makes it possible to block the airflow flowing into the cooling air path 50 at a position above the charger 122 (see the arrow D72 in FIG. 7 and the arrow D112 in FIG. 11), after the airflow has passed a position above the cleaning device 127 (see the arrow D71 in FIG. 7 and the arrow D111 in FIG. 11). Then, the flow direction of the airflow is deflected rightwardly, and the airflow is allowed to flow along the axis direction of the photosensitive drum 121 at a position above the charger 122. This makes it possible to prevent (block) the airflow from approaching the seal glass 90. Thus, it is possible to prevent the airflow from impinging on the seal glass 90, thereby preventing adhesion of toner or dust carried by the airflow onto the seal glass 90. Accordingly, it is possible to form an electrostatic latent image on the photosensitive drum 121 by the exposure device 123 in a satisfactory manner. Further, it is possible to appropriately cool the periphery of the cleaning device 127 and the charger 122, and the attachment plate 220 for supporting the exposure device 123 by the thus-controlled airflow.

Figure 12:
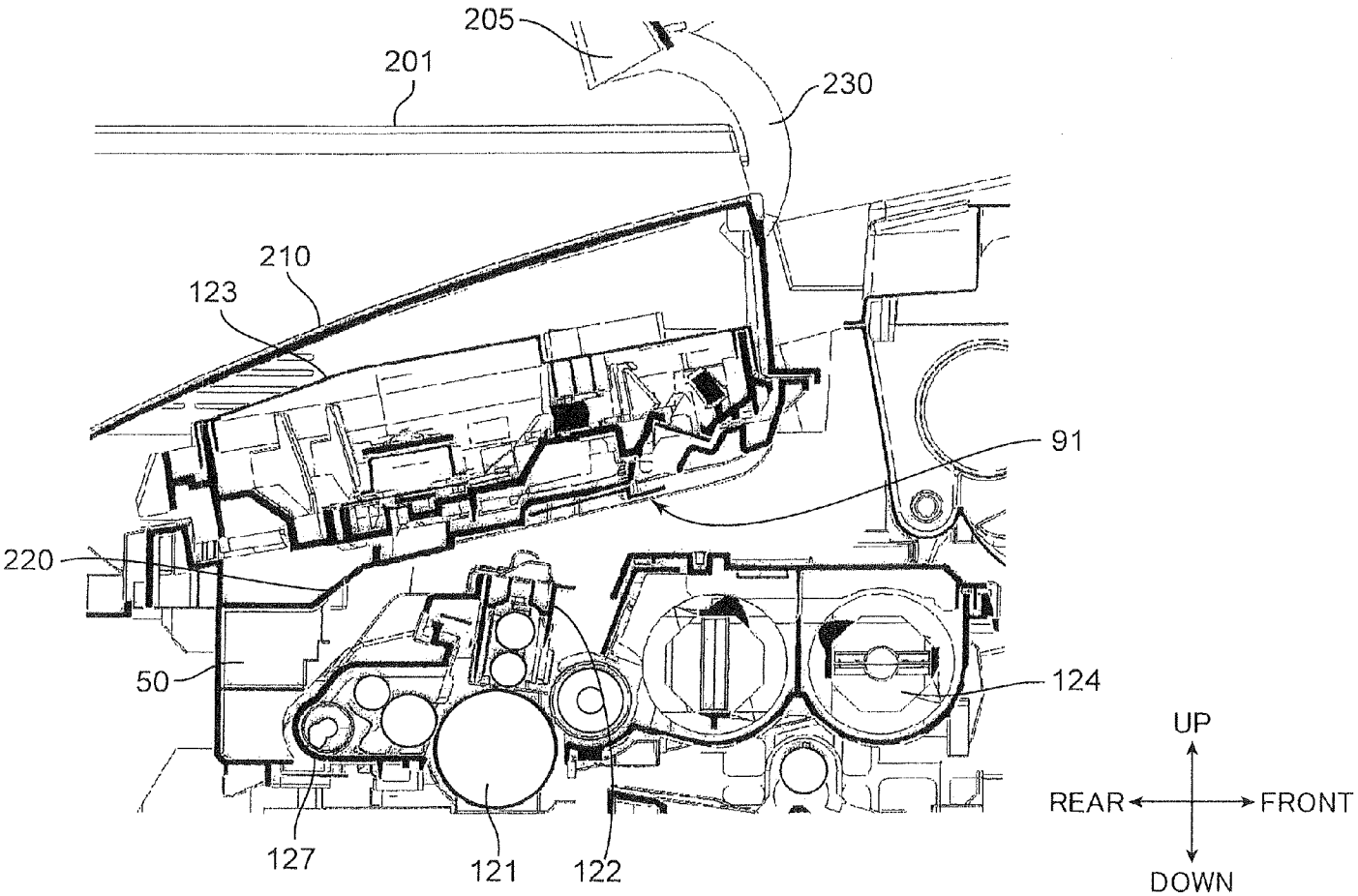
FIG. 12 is a cross sectional view showing the periphery of the image forming portion, in the case where the opening/closing cover is in an opened state in the image forming apparatus according to the first embodiment of the present disclosure.
Figure 13:
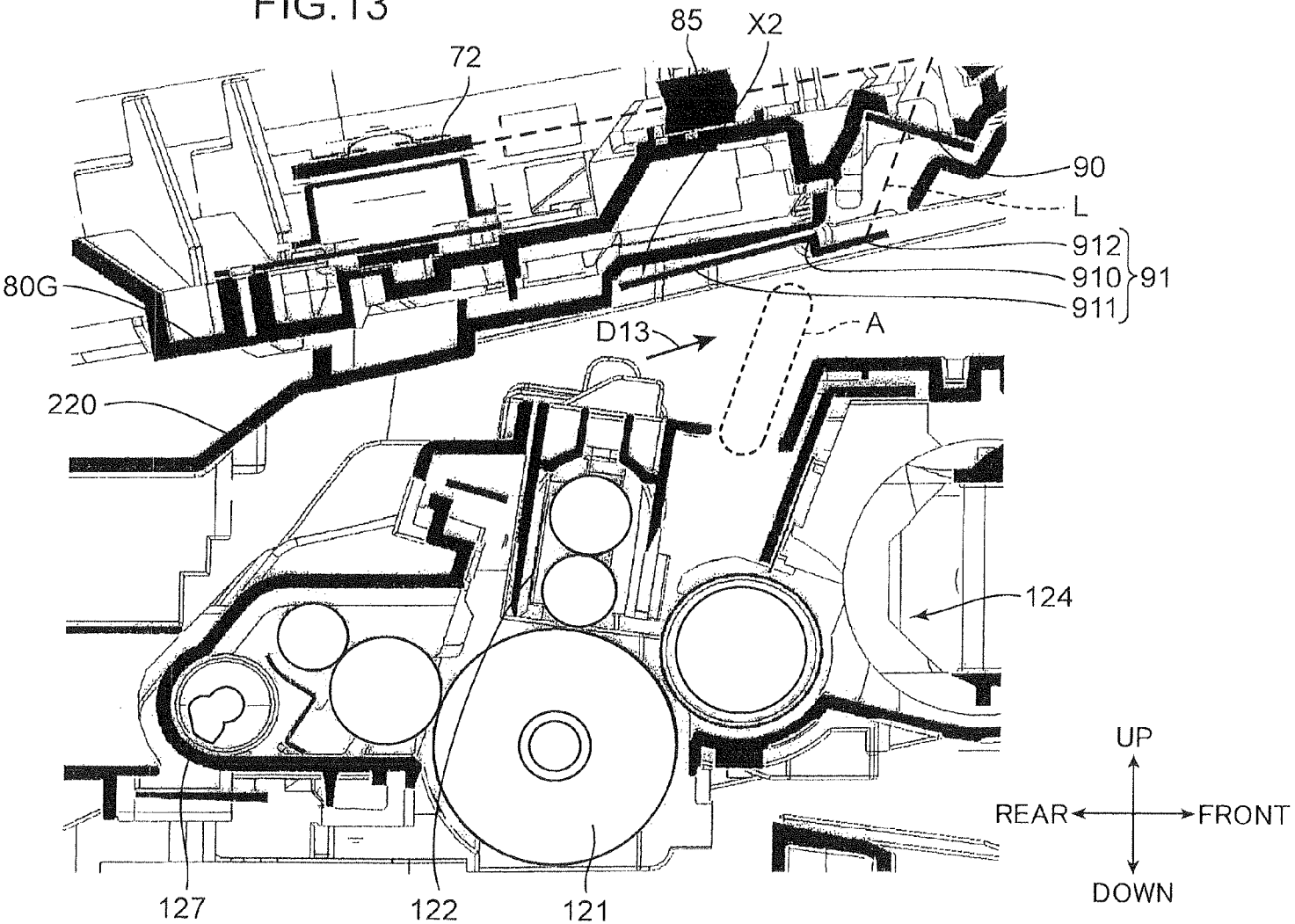
FIG. 13 is an enlarged sectional view showing part of FIG. 12.
Figure 14:
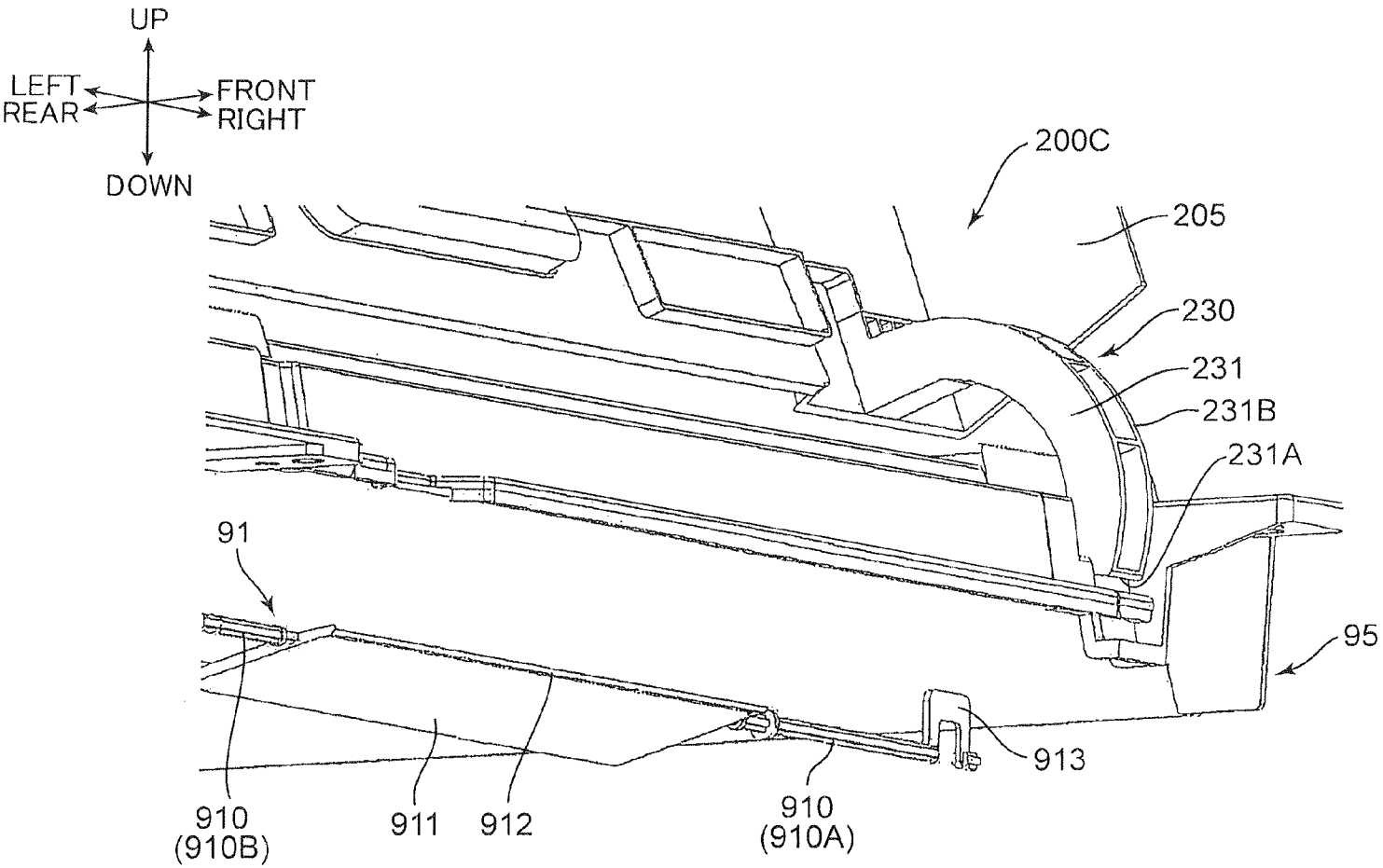
FIG. 14 is a perspective view showing a partition member and an arm portion when the opening/closing cover is in an opened state.
Figure 15:
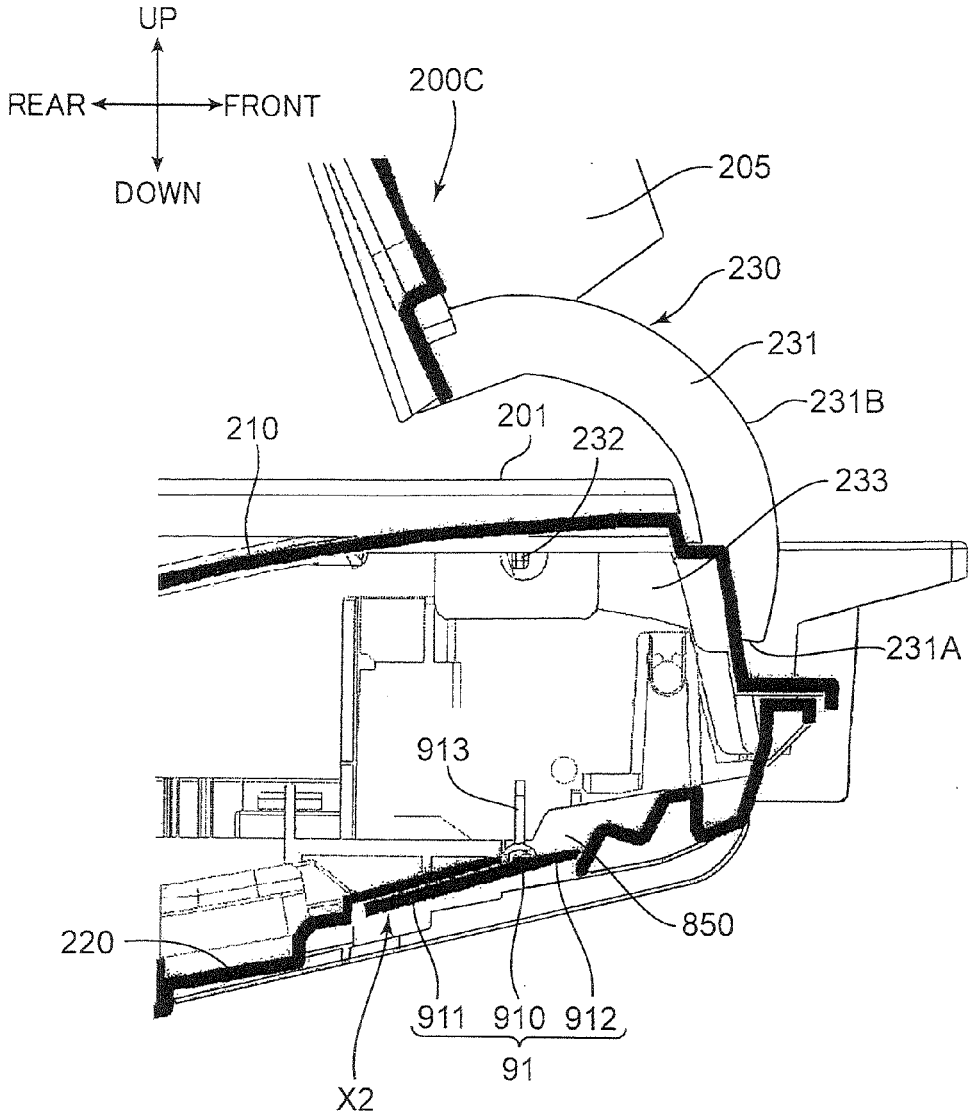
FIG. 15 is a cross sectional view of the state shown in FIG. 14.
Figure 16:
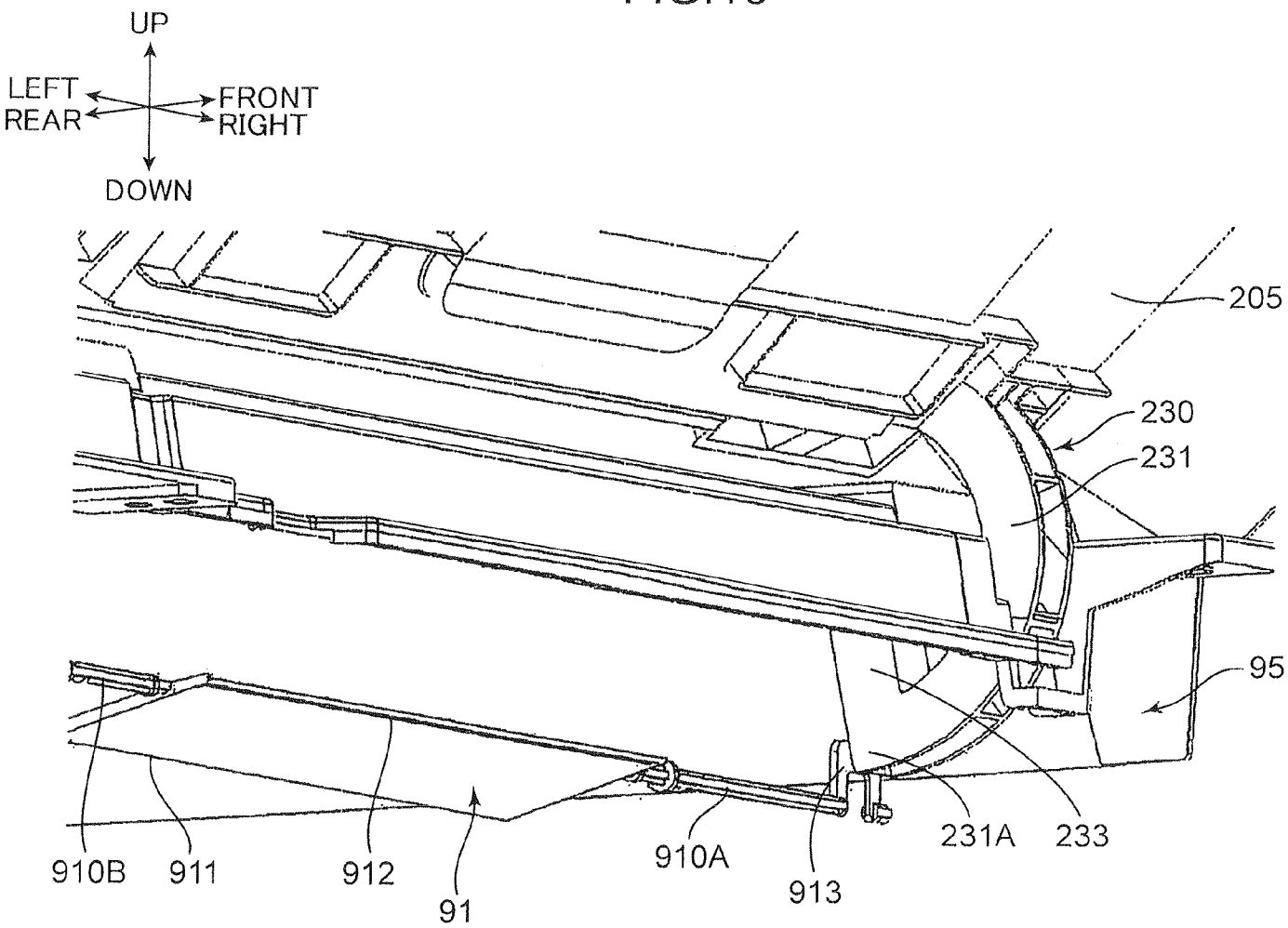
FIG. 16 is a perspective view showing the partition member and the arm portion in the course of closing the opening/closing cover.
Figure 17:
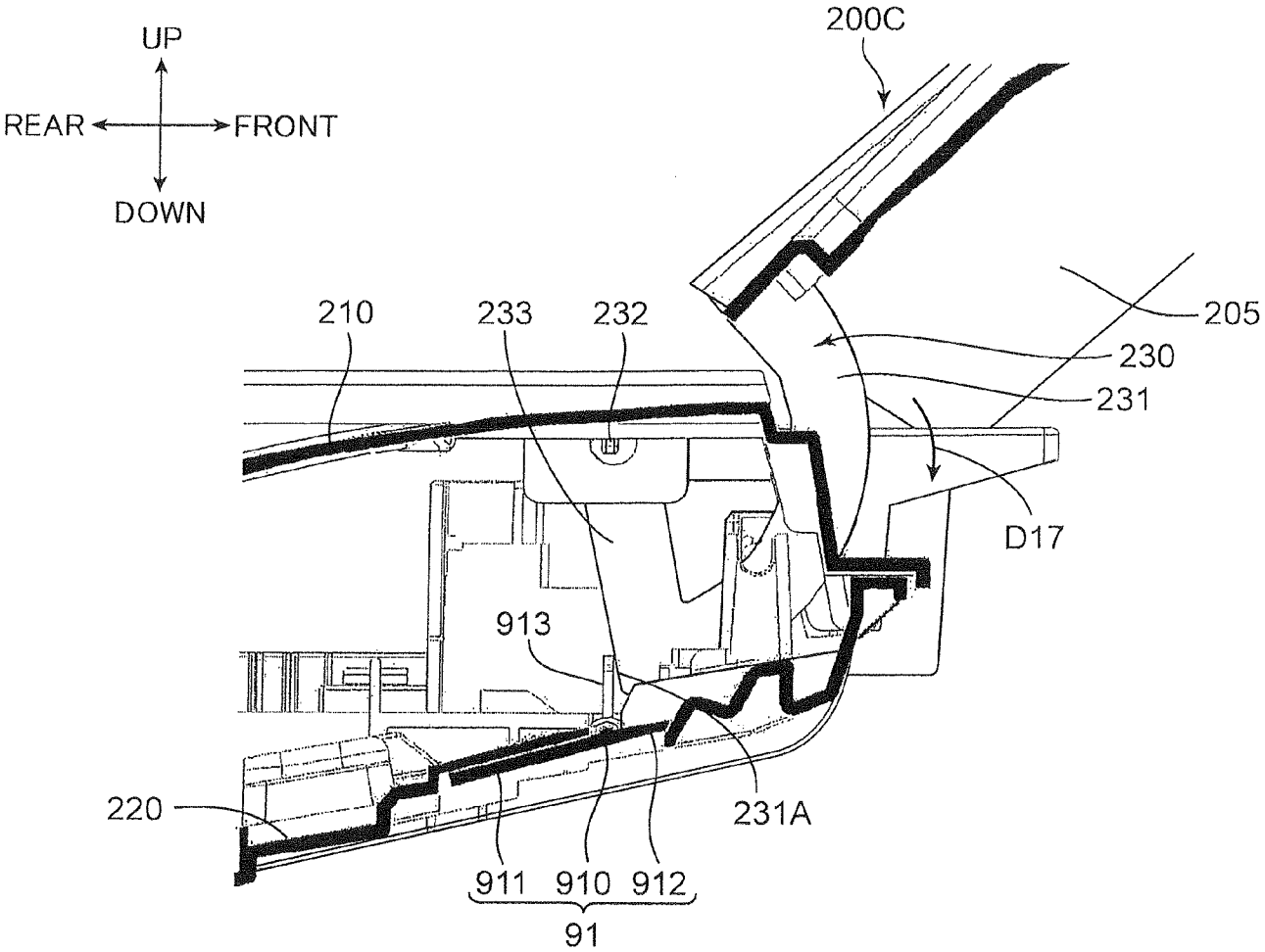
FIG. 17 is a cross sectional view of the state shown in FIG. 16.
Figure 18:
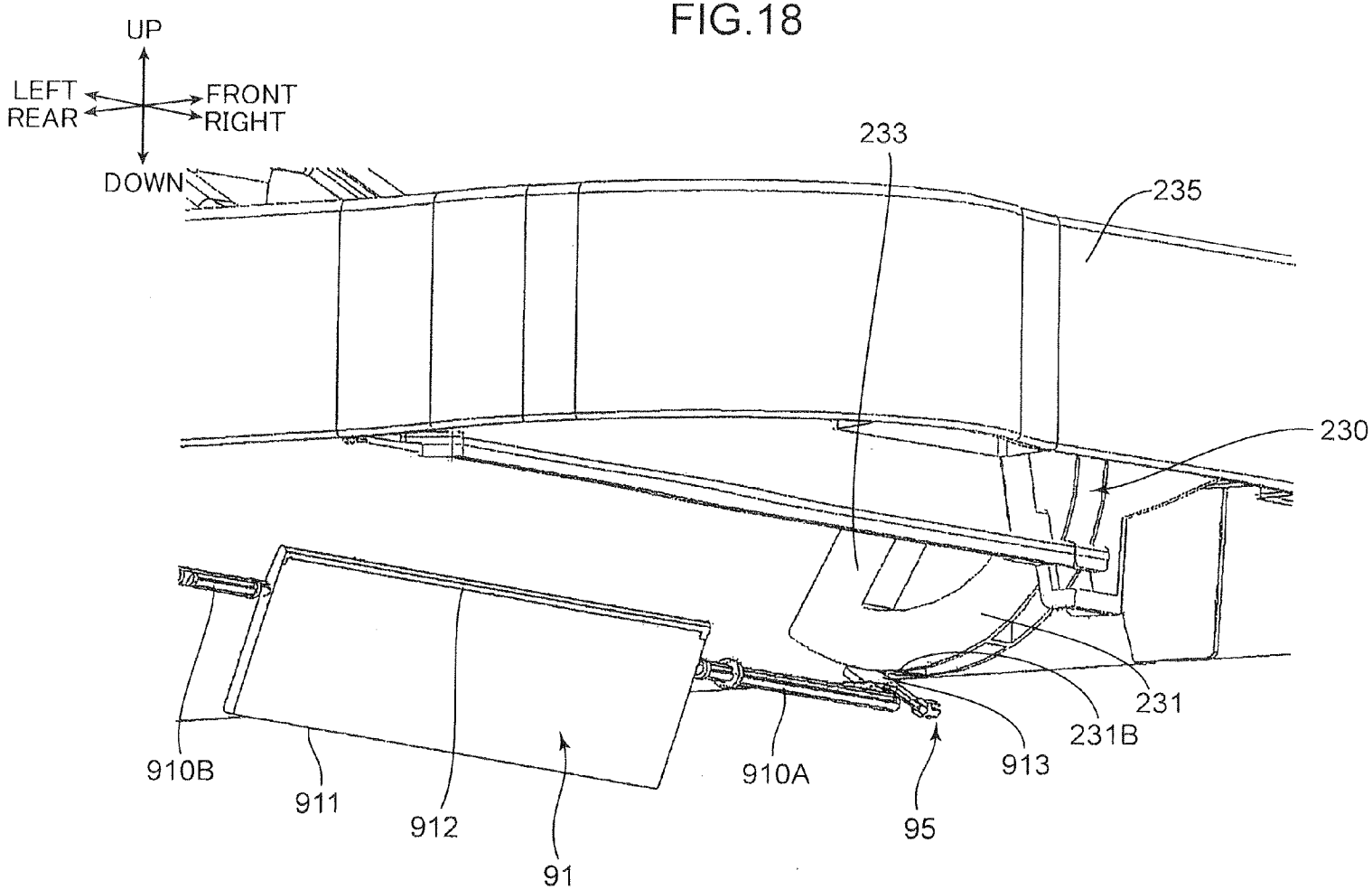
FIG. 18 is a perspective view showing the partition member and the arm portion when the opening/closing cover is in a closed state.
Figure 19:
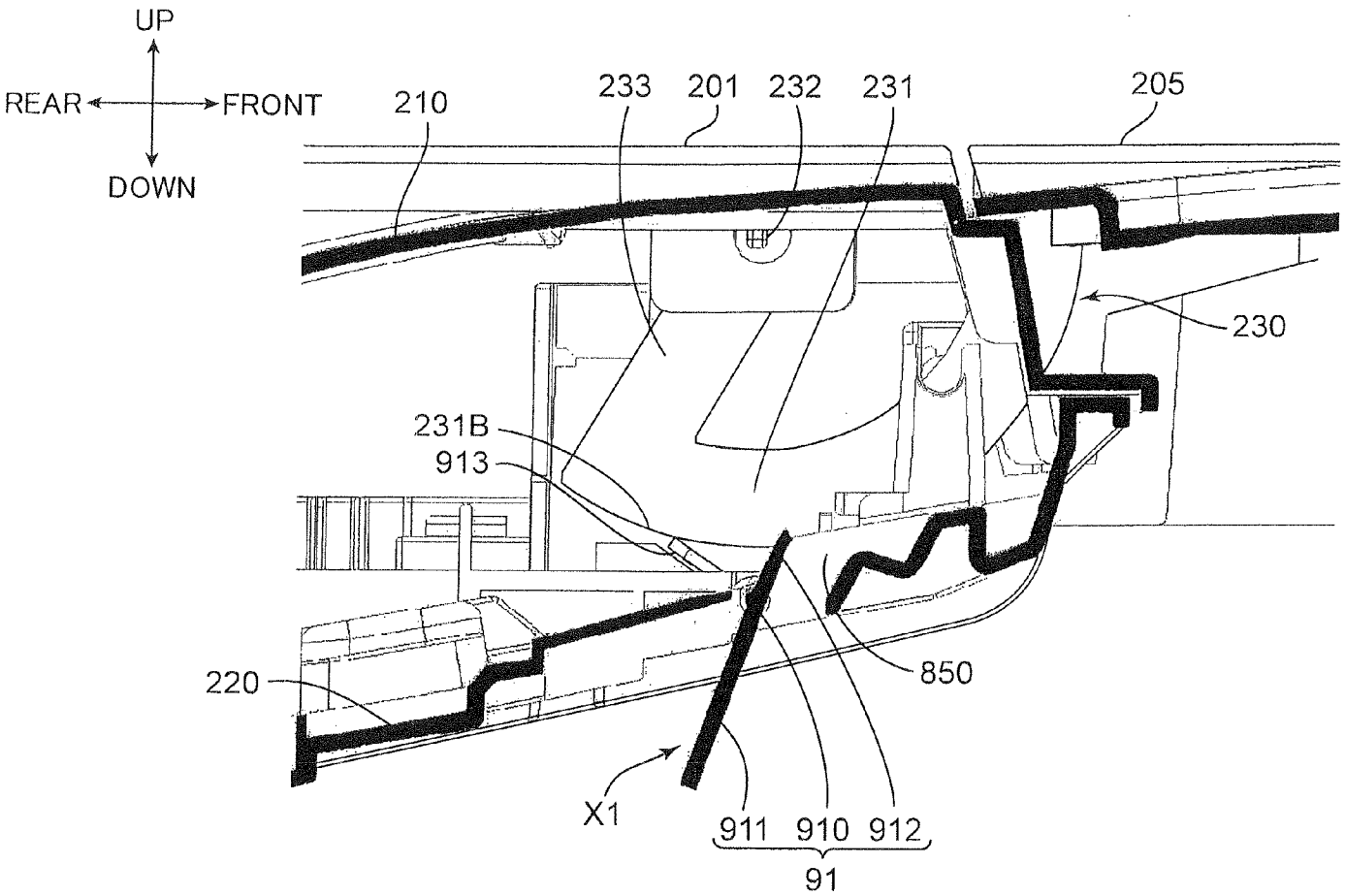
FIG. 19 is a cross sectional view of the state shown in FIG. 18.

Further, in this embodiment, the blocking member 91 is configured to change the position thereof to a spaced position X2 (see FIG. 13) closer to the exposure device 123 than the projecting position X1. In the following, the configuration and the layout of the blocking member 91 in this embodiment are described in detail referring to FIGS. 12 to 19. FIG. 12 is a cross sectional view of the periphery of the image forming portion in the printer 100 in this embodiment when the opening/closing cover 200C is in an opened state. FIG. 13 is an enlarged sectional view of part of FIG. 12. FIG. 14 is a perspective view showing the blocking member 91 and the arm portion 230 when the opening/closing cover 200C is in an opened state. FIG. 15 is a cross sectional view of the state shown in FIG. 14. FIG. 16 is a perspective view showing the blocking member 91 and the arm portion 230 in the course of an operation of closing the opening/closing cover 200C. FIG. 17 is a cross sectional view of the state shown in FIG. 16. FIG. 18 is a perspective view showing the blocking member 91 and the arm portion 230 when the opening/closing cover 200C is in a closed state. FIG. 19 is a cross sectional view of the state shown in FIG. 18.

Referring to FIG. 13 and FIG. 14, the blocking member 91 is provided with a shaft portion 910 (rotating shaft), an air path blocking portion 911 (first extending portion), and an optical path blocking portion 912 (second extending portion).

The shaft portion 910 of the blocking member 91 is a rotating shaft extending in left and right directions. The shaft portion 910 is rotatably supported on the casing 200. The shaft portion 910 is a rotating shaft about which the blocking member 91 is pivotally moved, as the blocking member 91 changes the position thereof. The shaft portion 910 is provided with a first shaft portion 910A and a second shaft portion 910B. The first shaft portion 910A is a shaft portion extending on the right side of the blocking member 91, and the second shaft portion 910B is a shaft portion extending on the left side of the blocking member 91.

The air path blocking portion 911 is a plate-shaped portion extending, between the first shaft portion 910A and the second shaft portion 910B, in a radial direction of rotation of the blocking member 91. When the blocking member 91 is in the spaced position X2 shown in FIG. 13, the air path blocking portion 911 extends from the shaft portion 910 toward the rear side of the apparatus body (backward). Further, the air path blocking portion 911 extends along the housing body 80G (see FIG. 5) (bottom portion) of the exposure device 123 and along the attachment plate 220. The air path blocking portion 911 extends from the exposure device 123 side toward the process unit 101 when the blocking member 91 is in the projecting position X1 (see FIG. 7).

The optical path blocking portion 912 is a plate-shaped portion extending from the shaft portion 910 toward the side opposite to the air path blocking portion 911 in the radial direction. The length of the optical path blocking portion 912 is set shorter than the length of the air path blocking portion 911. When the blocking member 91 is in the spaced position X2 shown in FIG. 13, the optical path blocking portion 912 extends forwardly from the shaft portion 910. Further, as well as the air path blocking portion 911, the optical path blocking portion 912 extends along the housing body 80G (see FIG. 5) (bottom portion) of the exposure device 123 and along the attachment plate 220. When the blocking member 91 is in the projecting position X1 (see FIG. 7), the optical path blocking portion 912 is allowed to enter the passage opening portion 851 (see FIG. 6) of the attachment plate 220, and extends toward the seal glass 90 of the exposure device 123.

The blocking member 91 is configured to change the position thereof between the projecting position X1 and the spaced position X2, as the block member 91 is pivotally moved about the axis of the shaft portion 910 of the blocking member 91. Comparing between the blocking member 91 in the projecting position X1 shown in FIG. 6 and FIG. 7, and the blocking member 91 in the spaced position X2 shown in FIG. 12 and FIG. 13, as the blocking member 91 is shifted toward the spaced position X2, a blocking space A shown in FIG. 13 is opened. As a result of the above operation, as will be described later, it is possible to prevent a likelihood that the blocking member 91 may obstruct an operation of dismounting the process unit 101 from the main body inner space 260 (in the direction of the arrow D13 in FIG. 13) when the opening/closing cover 200C is in an opened state.

<Position Changing of Blocking Member 91>

Further, in this embodiment, the blocking member 91 is configured to change the position thereof in association with an operation of opening and closing the opening/closing cover 200C. In this embodiment, the position of the blocking member 91 is changeable by an interlocking portion 95. The interlocking portion 95 shifts the blocking member 91 from the projecting position X1 to the spaced position X2 in association with an operation of shifting the opening/closing cover 200C from a closed state to an opened state. Referring to FIG. 14 and FIG. 15, the interlocking portion 95 is provided with a contact piece 913 (projecting piece) and the arm portion 230 (arm member).

The contact piece 913 is a projecting piece which projects in the radial direction of the shaft portion 910 at a right end of the first shaft portion 910A. The contact piece 913 projects in the radial direction from the first shaft portion 910A at a position spaced away from the air path blocking portion 911 by a certain distance in the circumferential direction of the first shaft portion 910A. As shown in FIG. 15, the contact piece 913 projects in a direction orthogonal to the air path blocking portion 911, specifically, in a direction away from the extending direction of the air path blocking portion 911 by an angle of from about 90 degrees to 100 degrees.

The arm portions 230 are disposed in pair at both ends of the upper wall front portion 205 of the opening/closing cover 200C in left and right directions thereof (see FIG. 2). The right arm portion 230 of the paired arm portions 230 constitutes the interlocking portion 95. Referring to FIG. 15, the arm portion 230 is provided with a curved portion 231, the hinge shaft 232, and an extending portion 233. The hinge shaft 232 is a rotating shaft extending in left and right directions, and serves as a rotating shaft about which the opening/closing cover 200C is pivotally moved for opening and closing the opening/closing cover 200C. The curved portion 231 is a member continuing from the upper wall front portion 205 of the opening/closing cover 200C, and has an arc shape. Specifically, an outer periphery 231B of the curved portion 231 has an arc shape about the axis of the hinge shaft 232. The extending portion 233 connects between a curved end 231A of the curved portion 231 on the opposite side of the upper wall front portion 205, and the hinge shaft 232.

Referring to FIG. 14 and FIG. 15, when the opening/closing cover 200C is in an opened state, as described above, the blocking member 91 is disposed at the spaced position X2. In other words, the blocking member 91 is disposed to extend along the attachment plate 220. Further, in the above state, the blocking member 91 is not disposed to project from the exposure device 123 toward the process unit 101. Since the opening/closing cover 200C is configured to be opened upwardly, a main part of the arm portion 230 is disposed above the upper wall 201 of the casing 200. In this configuration, the curved end 231A of the arm portion 230 is disposed to be spaced away from the contact piece 913 which radially extends from the shaft portion 910. The blocking member 91 is disposed at the spaced position X2 by the weight thereof. Further, the optical path blocking portion 912 of the blocking member 91 is disposed to be spaced away from the optical path L of laser light to be output through the seal glass 90.

When the operator finishes a certain operation in the main body inner space 260, for example, an operation of replacing the process unit 101, the operator starts an operation of closing the opening/closing cover 200C. During the above operation, as shown in FIG. 16 and FIG. 17, the curved end 231A comes into contact with the contact piece 913, as the arm portions 230 are pivotally moved (in the direction of the arrow D17 in FIG. 17). As a result of the above operation, the blocking member 91 starts to pivotally move about the axis of the shaft portion 910.

Further, when the opening/closing cover 200C is completely closed, as shown in FIG. 18 and FIG. 19, the pivotal movement of the blocking member 91 is stopped in a state that the outer periphery 231B of the arm portion 230 is pressingly contacted with the contact piece 913. As a result of the above operation, the blocking member 91 is disposed at the projecting position X1. Specifically, the air path blocking portion 911 of the blocking member 91 extends from the exposure device 123 side toward the process unit 101. Further, the blocking member 91 constitutes part of the cooling air path 50, thereby preventing an airflow from flowing toward the seal glass 90.

Further, in this embodiment, as shown in FIG. 13, when the opening/closing cover 200C is brought to an opened state, and the blocking member 91 is disposed at the spaced position X2, the optical path blocking portion 912 of the blocking member 91 is allowed to enter the optical path L of laser light to be output through the seal glass 90, and is disposed to block the optical path L. Accordingly, even in the case where laser light is inadvertently output from the exposure device 123, the optical path blocking portion 912 advantageously blocks the laser light. As a result of the above operation, even if the opening/closing cover 200C is in an opened state, it is less likely that laser light may come into the eyes of the operator.

<Process Unit 101>

Figure 20:
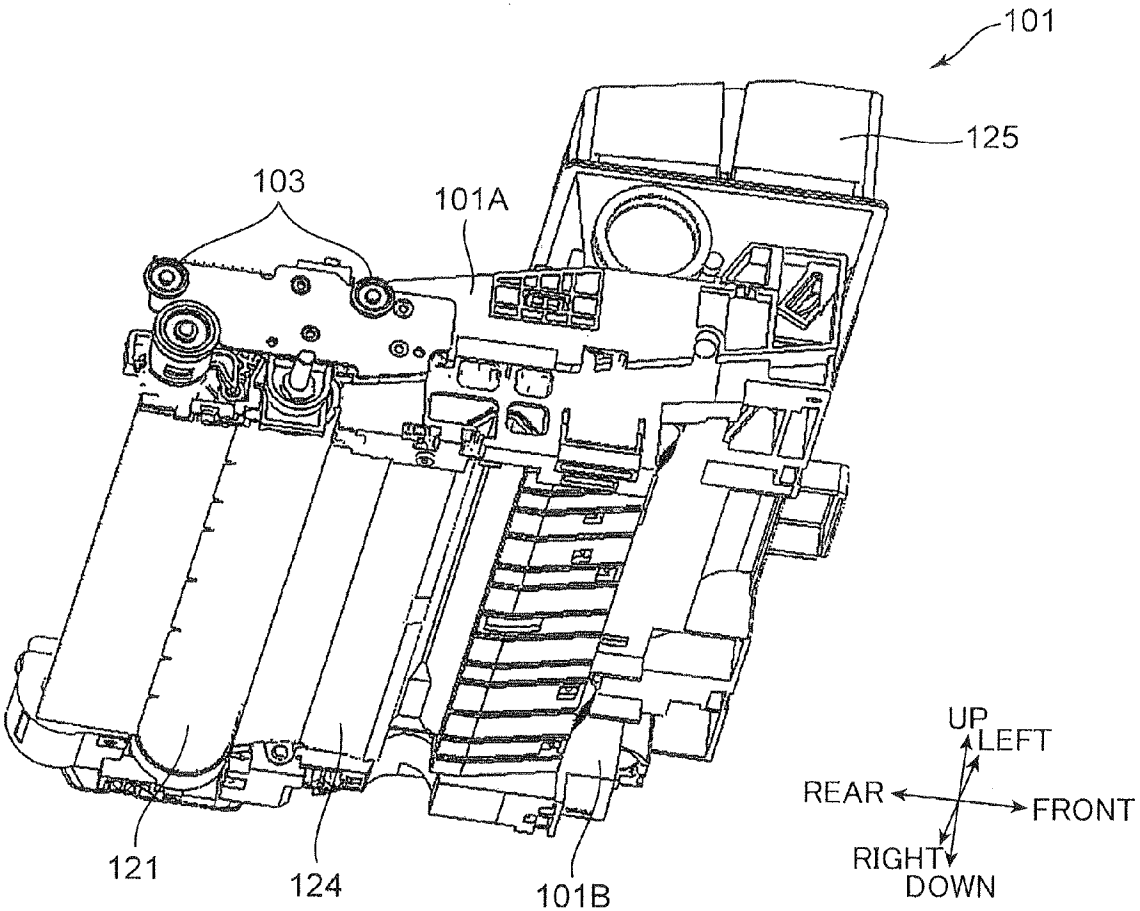
FIG. 20 is a perspective view of an image forming unit according to the first embodiment of the present disclosure.
Figure 21:
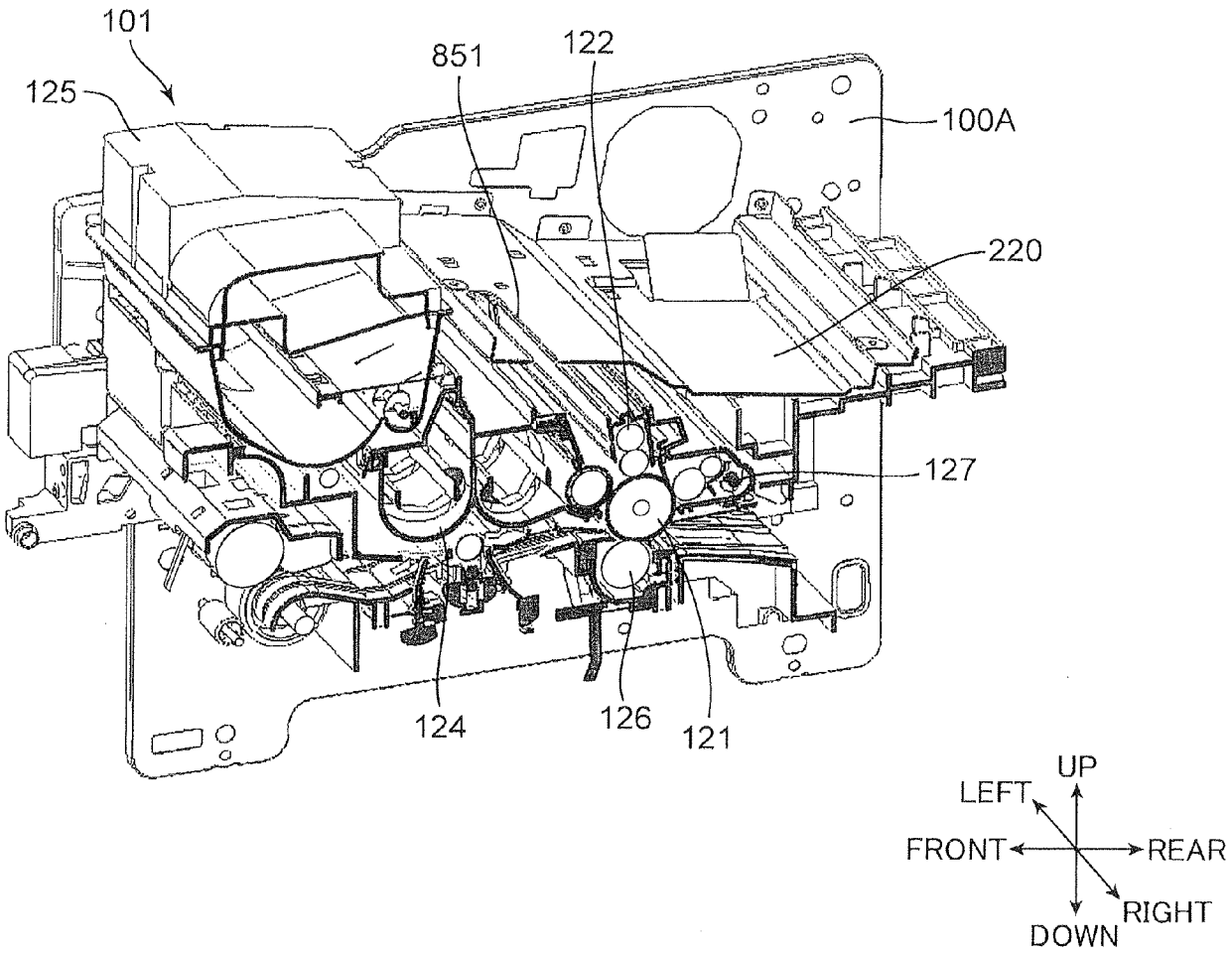
FIG. 21 is a sectional perspective view of the image forming unit in the image forming apparatus according to the first embodiment of the present disclosure.
Figure 24:
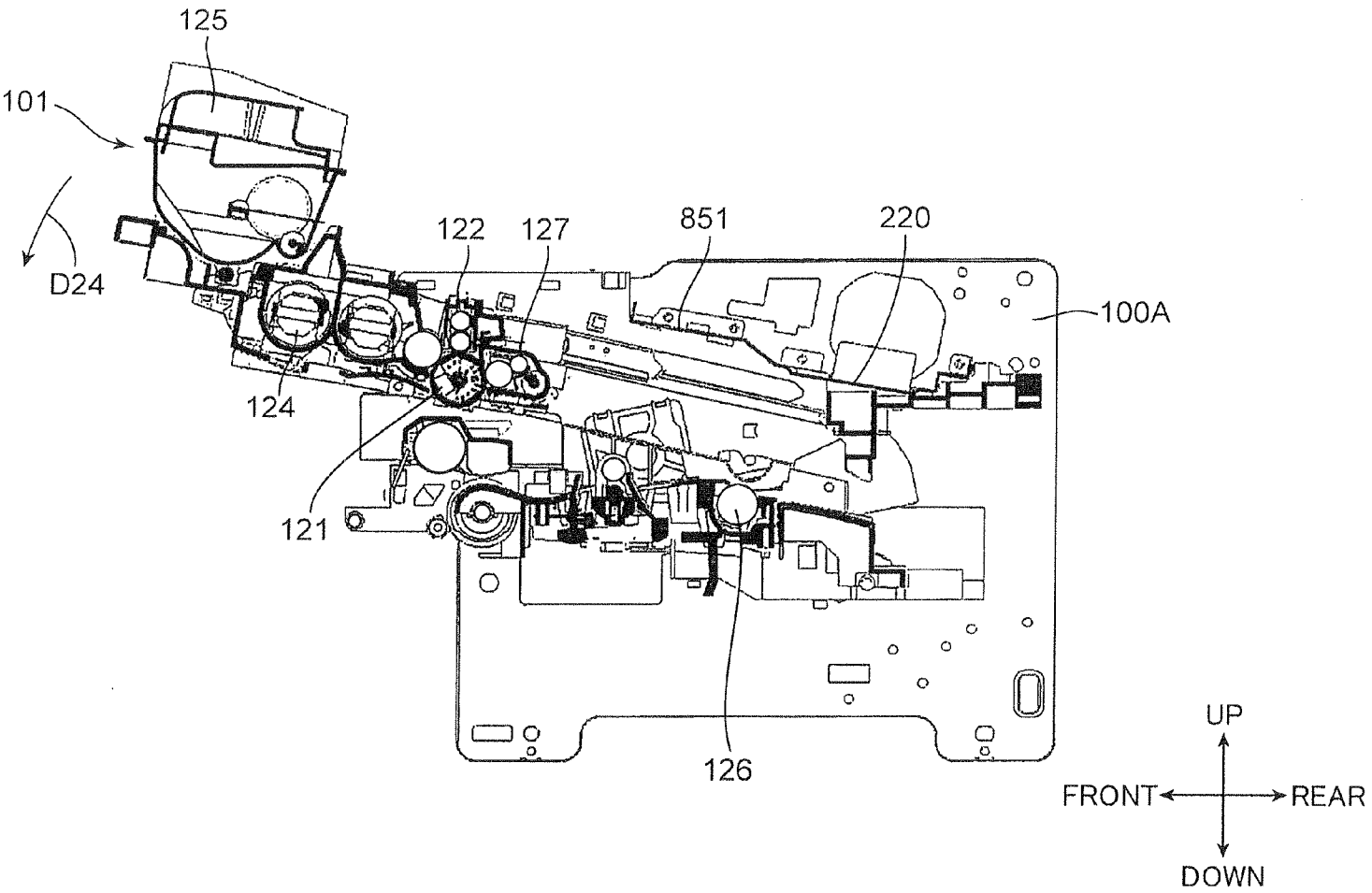
FIG. 24 is a cross sectional view showing a state that the image forming unit is moved forwardly in the image forming apparatus according to the first embodiment of the present disclosure.
Figure 25:
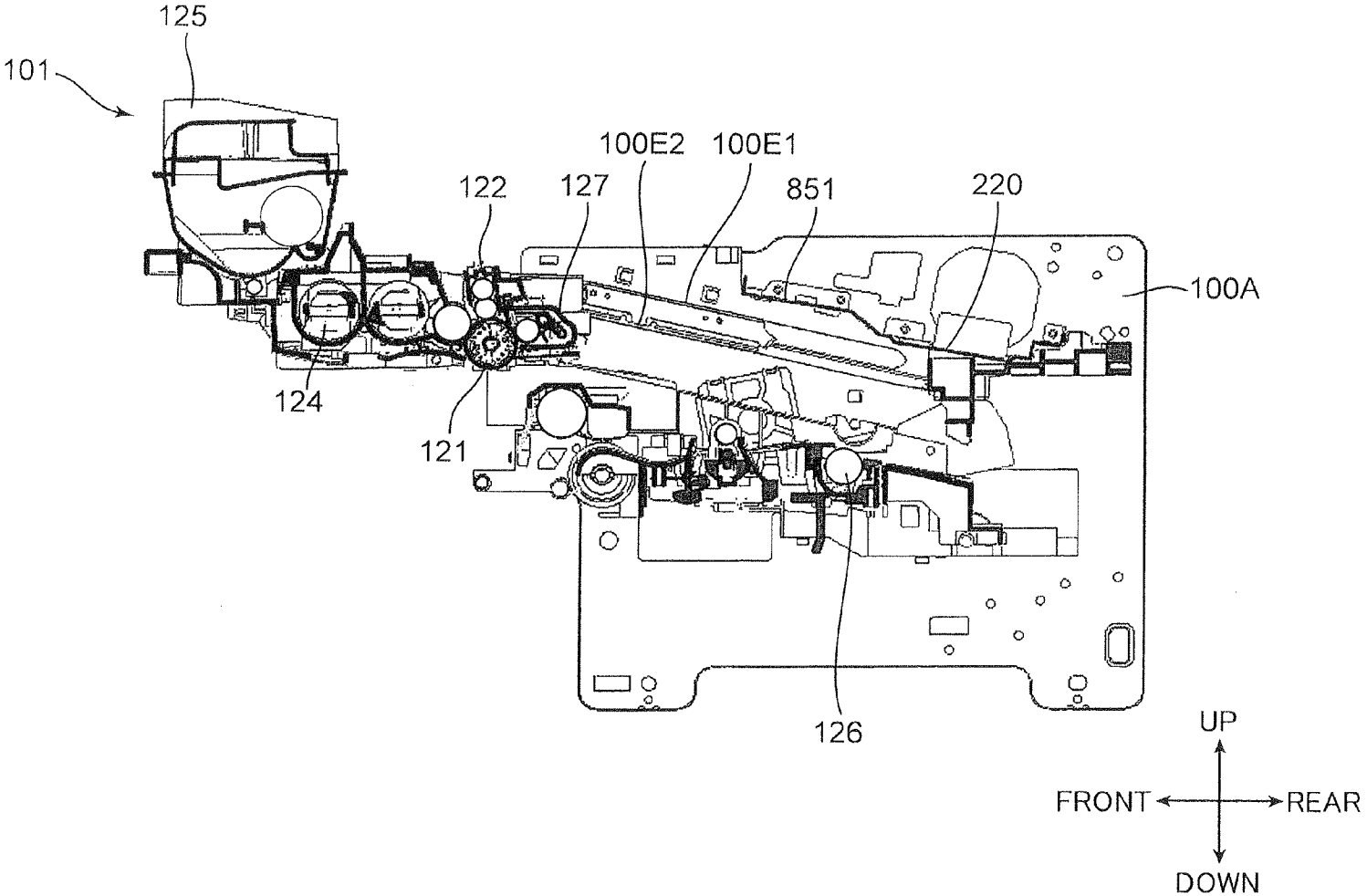
FIG. 25 is a cross sectional view showing a state that the image forming unit is moved further forwardly in the image forming apparatus according to the first embodiment of the present disclosure.
Figure 26:
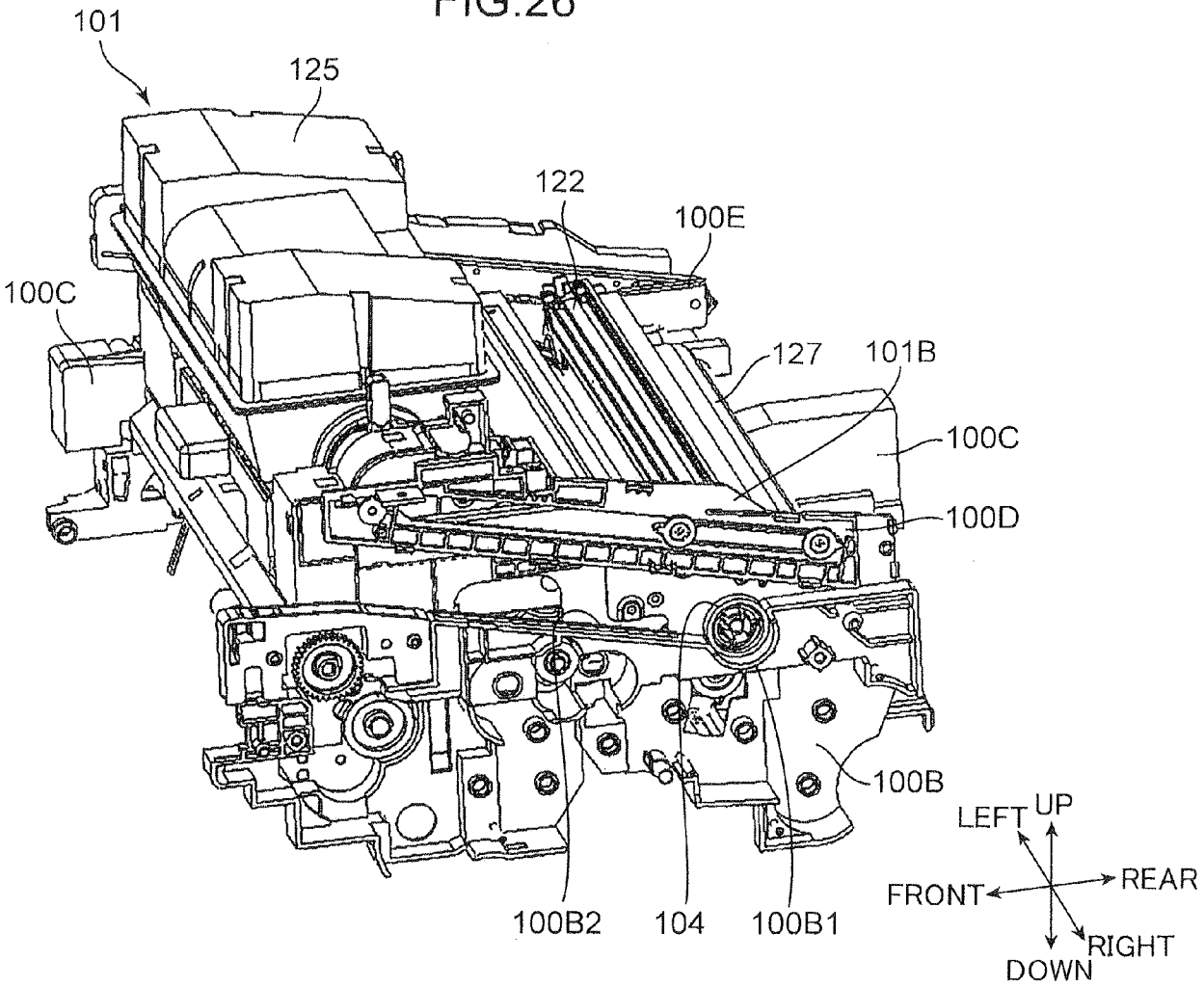
FIG. 26 is a perspective view showing the periphery of the image forming unit in the image forming apparatus according to the first embodiment of the present disclosure.
Figure 27:
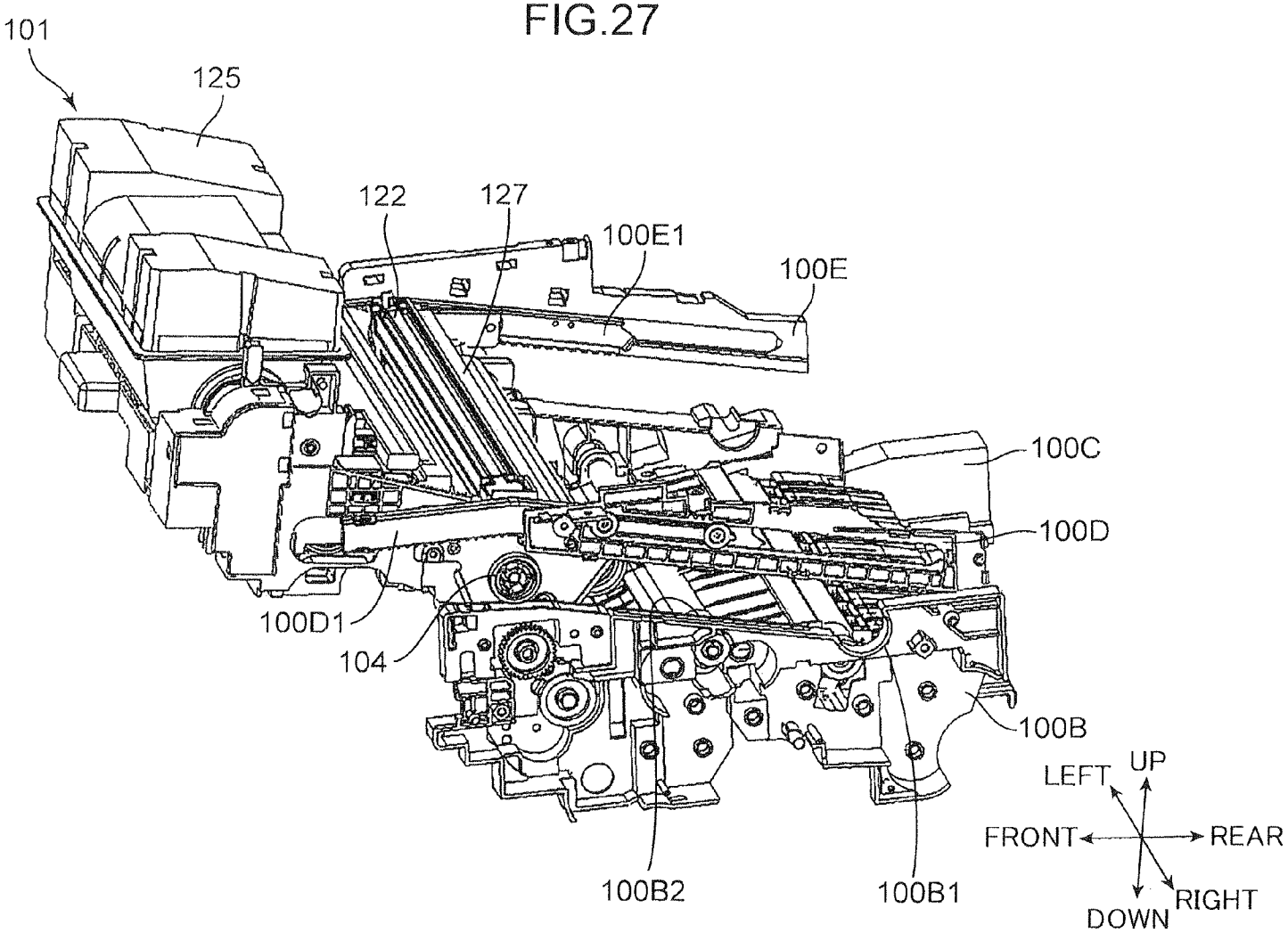
FIG. 27 is a perspective view showing a state that the image forming unit is moved forwardly in the image forming apparatus according to the first embodiment of the present disclosure.
Figure 28:
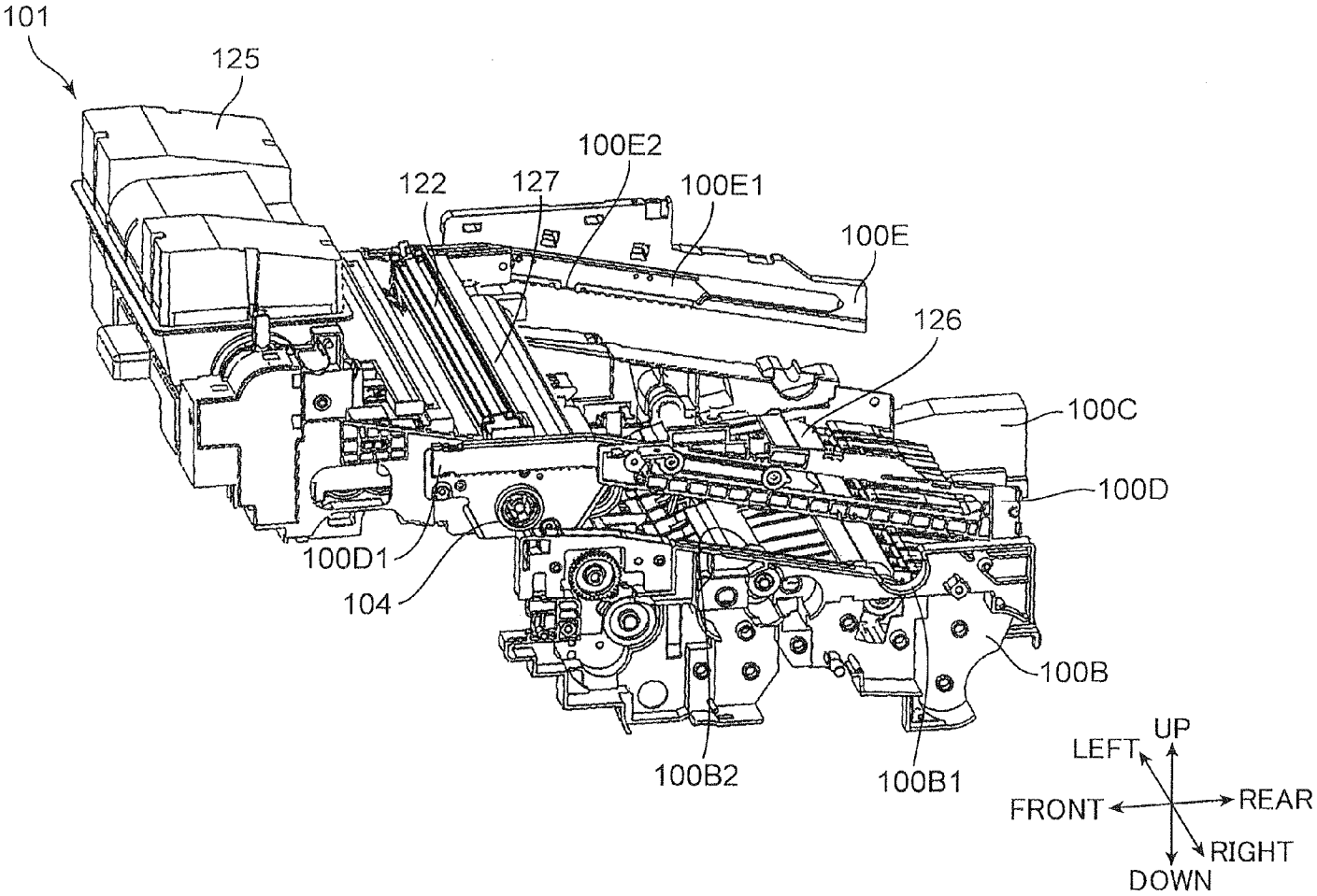
FIG. 28 is a perspective view showing a state that the image forming unit is moved further forwardly in the image forming apparatus according to the first embodiment of the present disclosure.

In this section, the structure of the process unit 101 (image forming unit), and a manner as to how the process unit 101 is mounted and dismounted to and from the casing 200 in this embodiment are described in detail referring to FIGS. 20 to 28, in addition to FIG. 5. Referring to FIG. 5, the region enclosed by the dotted line indicates a mounting/dismounting space RS necessary for the operator to mount and dismount the process unit 101. The cooling air path 50 between the attachment plate 220 and the process unit 101 is also used as the mounting/dismounting space RS. FIG. 20 is a perspective view of the process unit 101. FIG. 21 is a sectional perspective view of the process unit 101 in the main body inner space 260 of the casing 200. FIGS. 22 to 25 are cross sectional views showing a state as to how the process unit 101 is dismounted from the main body inner space 260 of the casing 200. FIGS. 26 to 28 are perspective views showing a manner as to how the process unit 101 is dismounted from the main body inner space 260 of the casing 200. A left inner wall portion 100A shown in FIGS. 21 to 25 corresponds to an inner wall portion of the left wall of the casing 200. Further, in FIGS. 21 to 25, the illustration of the blocking member 91 is omitted.

Referring to FIG. 20, the process unit 101 is supported by a pair of side walls 101A and 101B, which are disposed to face each other in left and right directions. The photosensitive drum 121, the charger 122, the developing device 124, the toner container 125, and the cleaning device 127 are integrally supported between the paired side walls 101A and 101B (see FIG. 21). Further, the process unit 101 is provided with unit rollers 103. Each of the unit roller 103 is constituted of two rollers which are disposed to be spaced away from each other on each of the side walls 101A and 101B. The unit rollers 103 serve as guide rollers in slidably moving the process unit 101 within the main body inner space 260.

Referring to FIG. 26, the casing 200 is provided with a right frame 100B, a left frame 100C, a right body rail 100D, and a left body rail 100E. The right frame 100B and the left frame 100C are respectively frames extending in front and rear directions along the right inner wall portion and the left inner wall portion of the casing 200. The right frame 100B and the left frame 100C are disposed, with the process unit 101 being interposed therebetween. The right frame 100B is provided with a right engaging portion 100B1 and a right guide portion 100B2. The right engaging portion 100B1 is a portion formed by cutting away part of an upper end edge of the right frame 100B in the shape of a downwardly projecting arc. The right guide portion 100B2 is part of the upper end edge of the right frame 100B, and extends from a front end of the right engaging portion 100B1 obliquely upwardly and forwardly. A disc-shaped right guide roller 104, which is mounted on the rotating shaft of the photosensitive drum 121, is engaged in the right engaging portion 101B on the side wall 101B of the process unit 101. Further, the same configuration as described above is provided on the left frame 100C and the side wall 101A (see FIG. 20) of the process unit 101.

Further, the right body rail 100D and the left body rail 100E are respectively rail members extending in front and rear directions at positions above the right frame 100B and the left frame 100C. In FIG. 2, the illustration of the right frame 100B and the right body rail 100D is omitted. Referring to FIG. 26 and FIG. 28, the right body rail 100D and the left body rail 100E are respectively provided with a right movable rail 100D1 and a left movable rail 100E1 which are slidably movable in such a direction as if they extend forwardly. Each of the right movable rail 100D1 and the left movable rail 100E1 has a generally V shape in side plan view, and has upper and lower guide surfaces so that the unit rollers 103 mounted on the side walls 101A and 101B of the process unit 101 are movable relative to the right movable rail 100D1 and the left movable rail 100E1 in engagement with the right movable rail 100D1 and the left movable rail 100E1 (see FIG. 20). Further, as shown in FIG. 25 and FIG. 28, part of the lower guide surface of the right movable rail 100D1 is cut away into a retraction portion 100D2, and part of the lower guide surface of the left movable rail 100E1 is cut away into a retraction portion 100E2 (in FIG. 25 and FIG. 28, only the retraction portion 100E2 is shown).

Figure 22:
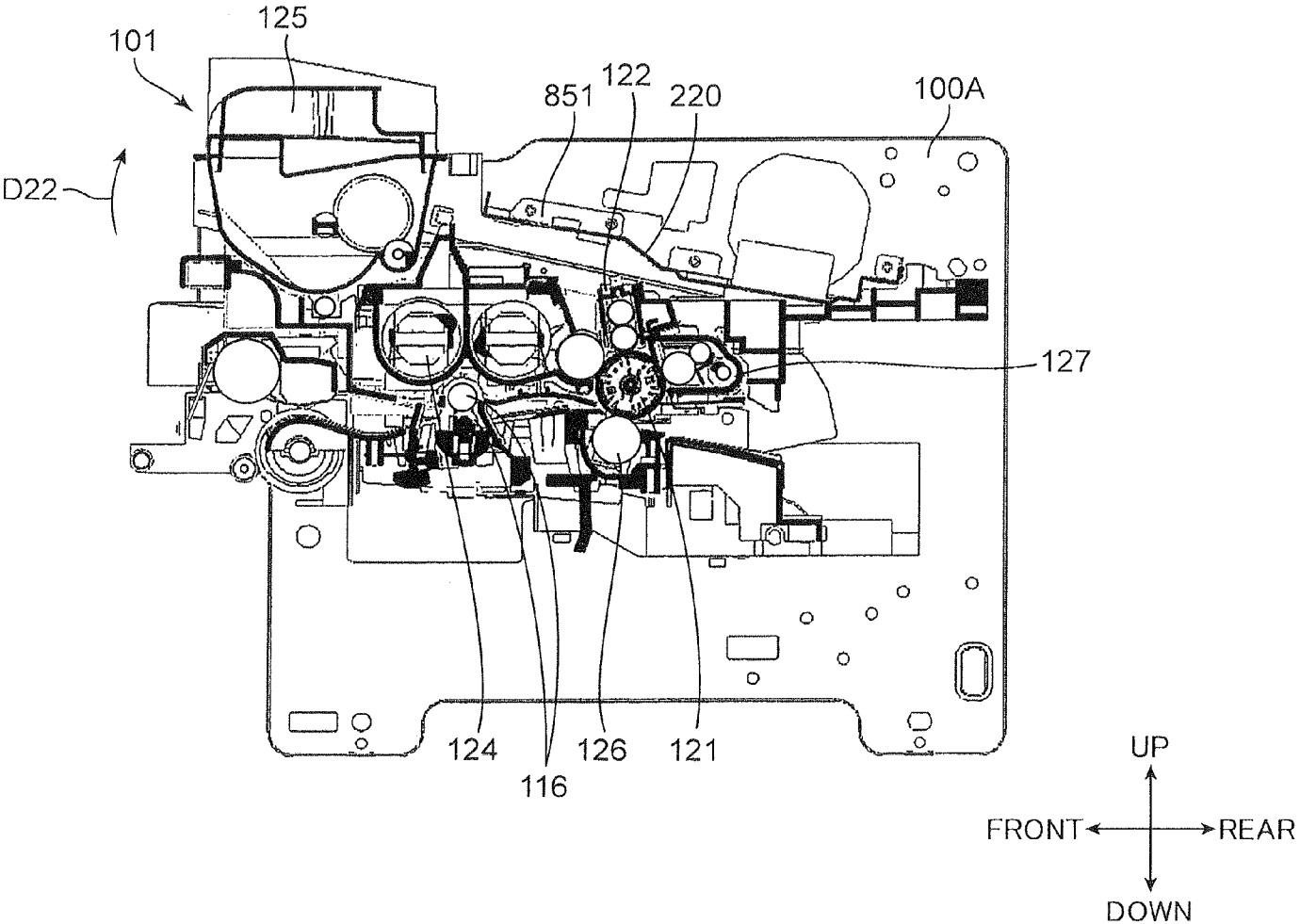
FIG. 22 is a cross sectional view showing the layout of the image forming unit in the image forming apparatus according to the first embodiment of the present disclosure.

FIG. 21, FIG. 22, and FIG. 26 show a state that the process unit 101 is mounted to a predetermined position in the main body inner space 260. Specifically, as described above, these drawings show a state in which the process unit 101 faces the exposure device 123 and the transfer roller 126 for image formation (for irradiating laser light transmitted through the seal glass 90 onto the photosensitive drum 121). In this state, a space is formed between the charger 122 in the process unit 101 and the developing device 124, and the attachment plate 220 of the casing 200 (see FIG. 21 and FIG. 22). In this state, the front-side unit rollers 103 on the side walls 101A and 101B are disposed at such positions as to face the retraction portions 100D2 and 100E2 formed in the right movable rail 100D1 and in the left movable rail 100E1, and are disengaged from the lower guide surfaces of the right movable rail 100D1 and of the left movable rail 100E1. The process unit 101 is pivotally moved about the axes of the rear-side unit rollers 103 on the side walls 101A and 101B, and the right guide roller 104 of the process unit 101 is engaged in the right engaging portion 100B1.

In the case where the process unit 101 is dismounted from the main body inner space 260 of the casing 200, as shown in FIG. 2, the opening/closing cover 200C of the casing 200 and the manual tray 240 are respectively brought to an opened state. As a result of the above operation, the upper and front portion of the main body inner space 260 are opened to the outside of the casing 200.

Figure 23:
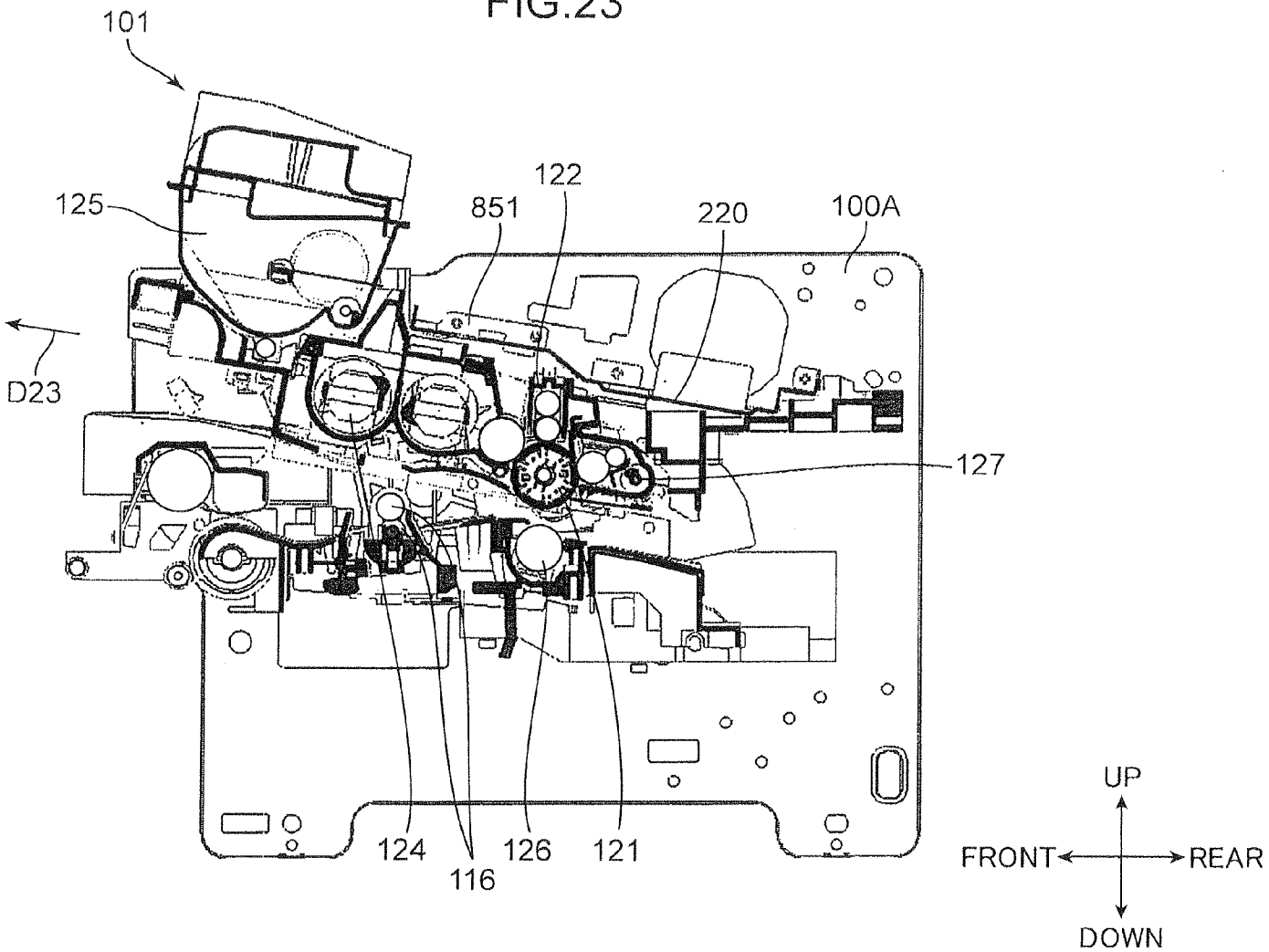
FIG. 23 is a cross sectional view showing a state that the image forming unit is moved upwardly in the image forming apparatus according to the first embodiment of the present disclosure.

At first, in dismounting the process unit 101 from the main body inner space 260, the portion of the process unit 101 on the toner container 125 side is pivotally moved upwardly about the axes of the rear-side unit rollers 103 on the side walls 101A and 101B (see the arrow D22 in FIG. 22). In performing the above operation, the process unit 101 is pivotally movable until the outer circumferential surfaces of the front-side unit rollers 103 on the side walls 101A and 101B come into contact with the upper guide surfaces of the right movable rail 100D1 and the left movable rail 100E1. As a result of the above operation, as shown in FIG. 23, the charger 122 in the process unit 101, and the developing device 124 approach the attachment plate 220 of the casing 200 (second position). Further, the photosensitive drum 121 is upwardly moved away from the transfer roller 126. In this way, upwardly moving the photosensitive drum 121 away from the transfer roller 126 in the direction of a straight line connecting between the axes of the photosensitive drum 121 and the transfer roller 126 makes it possible to prevent friction between the circumferential surfaces of the photosensitive drum 121 and the transfer roller 126, thereby suppressing damages on the circumferential surfaces thereof. Further, since the bottom surface of the process unit 101 is upwardly moved away from the registration roller pair 116, there is no likelihood that the process unit 101 and the registration roller pair 116 may interfere with each other in the direction of taking out the process unit 101.

Further, as shown by the arrow D23 in FIG. 23, the process unit 101 is taken out forwardly while being inclined slightly upwardly. During the above operation, the right guide roller 104 of the process unit 101 is moved forwardly while rolling over the right guide portion 100B2 (see FIG. 26). Further, the right movable rail 100D1 and the left movable rail 100E1 extend in forward direction. As a result of the above operation, the process unit 101 is disposed in the state as shown in FIG. 24 and FIG. 27.

Then, the process unit 101 is taken out further forwardly. Specifically, allowing the unit rollers 103 (see FIG. 20) of the process unit 101 to roll on the inside of the right movable rail 100D1 (left movable rail 100E1) makes it possible to move the process unit 101 forwardly while inclining the portion of the process unit 101 on the toner container 125 side downwardly (see the arrow D24 in FIG. 24). As far as the right guide roller 104 of the process unit 101 is supported on the right guide portion 100B2, it is possible to restrict disengagement of the rear-side unit rollers 103 on the side walls 101A and 101B from the retraction portions 100D2 and 100E2 respectively formed in the right movable rail 100D1 and in the left movable rail 100E1. As a result of the above operation, the process unit 101 is disposed in the state as shown in FIG. 25 and FIG. 28. In this state, the right guide roller 104 of the process unit 101 is disposed at a front end of the right guide portion 100B2 (see FIG. 28). Thereafter, taking out the process unit 101 further forwardly to such an extent that the unit rollers 103 on the process unit 101 are disengaged from the right movable rail 100D1 (left movable rail 100E1) makes it possible to completely dismount the process unit 101 from the casing 200. Then, after a predetermined maintenance service is carried out for the process unit 101, the process unit 101 is mounted in the main body inner space 260 of the casing 200 according to the procedure reverse to the aforementioned procedure. Alternatively, a new process unit 101 other than the taken-out process unit 101 may be mounted in the main body inner space 260.

It is possible for the operator to access the periphery of the transfer roller 126 in the main body inner space 260 in the state as shown in FIG. 25 and FIG. 28. Accordingly, for instance, in the case where a sheet S is jammed between the photosensitive drum 121 and the transfer roller 126 during image formation, it is possible for the operator to take out the jammed sheet S after taking out the process unit 101 as shown in FIG. 25 and FIG. 28.

As described above, in this embodiment, the process unit 101 is provided with the photosensitive drum 121 onto which laser light transmitted through the seal glass 90 of the exposure device 123 is irradiated, and the process unit 101 is mounted to the first position facing the exposure device 123 in the main body inner space 260 of the casing 200. Further, the process unit 101 is configured to be mounted and dismounted to and from the main body inner space 260 when the opening/closing cover 200C and the manual tray 240 are in an opened state.

As described above, the illustration of the blocking member 91 is omitted in FIGS. 21 to 28. Disposing the blocking member 91 between the exposure device 123 and the process unit 101 makes it possible to prevent an airflow flowing into the main body inner space 260 from directing toward the seal glass 90. However, as shown in FIG. 7, in the case where the blocking member 91 is disposed to extend downwardly from the attachment plate 220, the blocking member 91 may obstruct an operation of dismounting the process unit 101 (in the direction of the arrow D73 in FIG. 7). In particular, as described in this embodiment, in which the process unit 101 is mounted and dismounted in a direction orthogonal to the axis direction of the photosensitive drum 121, the aforementioned drawback is likely to occur. Further, during the dismounting operation, in the case where the process unit 101 is shifted to the second position closer to the exposure device 123 than the first position for avoiding friction between the photosensitive drum 121 and the transfer roller 126, it is highly likely that the blocking member 91 as a partition wall of the cooling air path 50 may obstruct the operation of dismounting the process unit 101. Even in such a condition, as described above in this embodiment, it is possible to dispose the blocking member 91 at the spaced position X2. In particular, even in the case where the process unit 101 is dismounted from the main body inner space 260, after the process unit 101 has been shifted to the second position closer to the exposure device 123 than the first position, the blocking member 91 disposed at the spaced position X2 is allowed to be disposed on the exposure device 123 side with respect to the process unit 101 in the second position. Accordingly, an operation of dismounting the process unit 101 is appropriately performed. Namely, the blocking member 91 allows the process unit 101 to be dismounted from the main body inner space 260 when the opening/closing cover 200C is in an opened state (second state of the blocking member 91).

Further, in this embodiment, the interlocking portion 95 causes the blocking member 91 to shift from the projecting position X1 to the spaced position X2 in association with an operation of shifting the opening/closing cover 200C from a closed state to an opened state. Accordingly, the blocking member 91 is smoothly disposed at the spaced position X2 before the process unit 101 is mounted and dismounted. Further, the air path blocking portion 911 of the blocking member 91 is disposed to extend along the housing body 80G of the exposure device 123 when the opening/closing cover 200C is in an opened state. Further, as the opening/closing cover 200C is shifted from an opened state to a closed state, the blocking member 91 is pivotally moved about the axis of the shaft portion 910 by contact of the arm portion 230 with the contact piece 913. As a result of the above operation, the air path blocking portion 911 of the blocking member 91 projects toward the process unit 101. Thus, the contact piece 913 of the interlocking portion 95 and the arm member 230 makes it possible to appropriately move the air path blocking portion 911 of the blocking member 91.

Further, in this embodiment, as the opening/closing cover 200C is shifted from a closed state to an opened state, and the arm member 230 is moved away from the contact piece 913, the blocking member 91 is disposed at the spaced position X2 by the weight thereof. Accordingly, it is possible to smoothly shift the blocking member 91 between the spaced position X2 and the projecting position X1 in association with an operation of opening and closing the opening/closing cover 200C.

Further, in this embodiment, the optical path blocking portion 912 is disposed to be spaced away from the optical path L of laser light to be output through the seal glass 90 when the blocking member 91 is in the projecting position X1. Accordingly, there is no likelihood that the optical path blocking portion 912 may obstruct irradiation of laser light when the opening/closing cover 200C is in a closed state. On the other hand, the optical path blocking portion 912 is disposed at such a position that blocks the optical path L of laser light when the blocking member 91 is in the spaced position X2. Accordingly, it is possible to prevent laser light from leaking to the outside of the casing 200 when the opening/closing cover 200C is in an opened state.

In the foregoing embodiment, the blocking member 91 constitutes part of the cooling air path 50, and also has a function of blocking laser light to be output through the seal glass 90. The present disclosure, however, is not limited to the above. The blocking member 91 may not have a function of blocking the laser light. Further, the blocking member 91 may have a function of cleaning the surface of the process unit 101.

Figure 29:
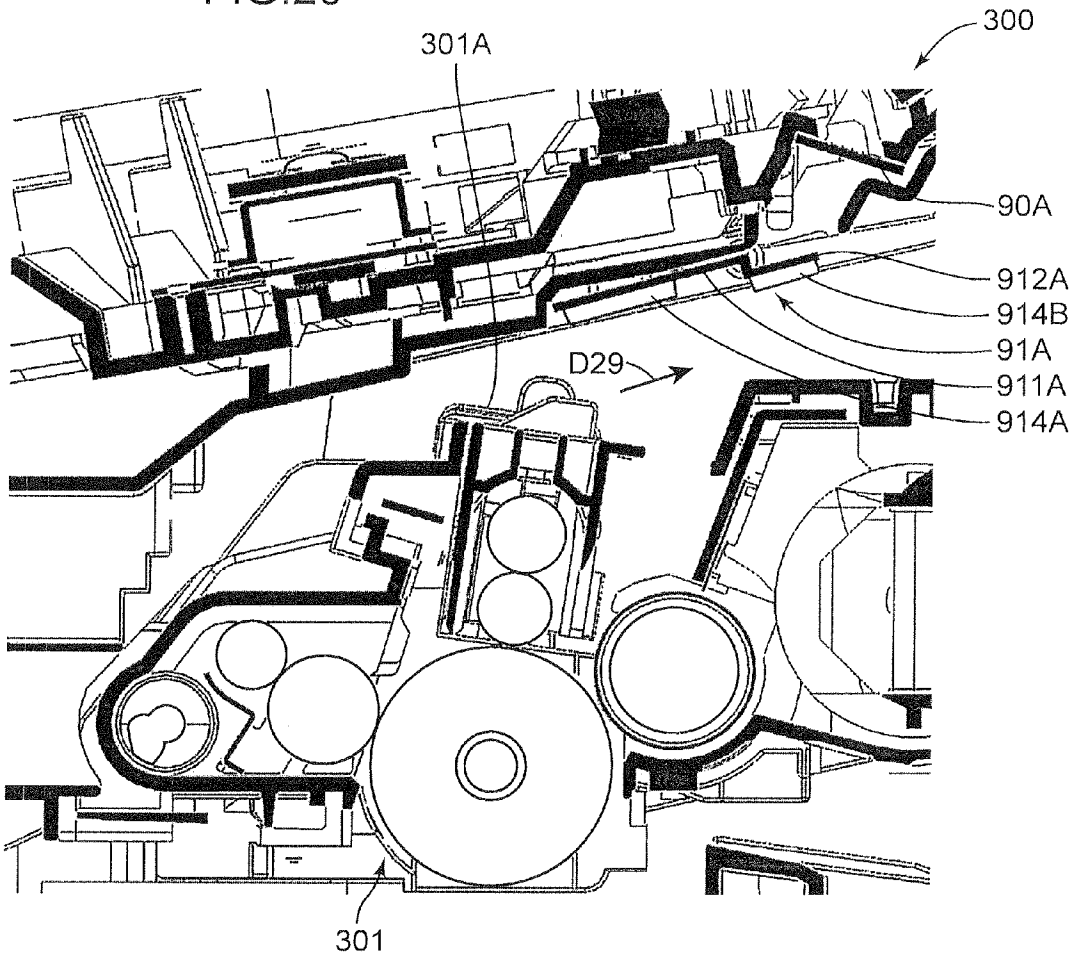
FIG. 29 is a cross sectional view showing the periphery of an image forming portion in an image forming apparatus according to a second embodiment of the present disclosure.

Next, a printer 300 (image forming apparatus) according to a second embodiment of the present disclosure is described. The second embodiment is different from the first embodiment in the configuration of a blocking member 91A. Accordingly, the second embodiment is described mainly on the above difference, and description on the same elements as those in the first embodiment will be omitted herein. FIG. 29 is a cross sectional view of the printer 300 provided with the blocking member 91A (partition member) in this embodiment. The blocking member 91A is provided with cleaning member 914A and 914B respectively on one surfaces of an air path blocking portion 911A and an optical path blocking portion 912A. Each of the cleaning members 914A and 914B is formed of a sponge member. When a process unit 301 is dismounted from a main body inner space 260 (in the direction of the arrow D29 in FIG. 29), an upper surface portion 301A of the process unit 301 contacts with the cleaning members 914A and 914B, so that the toner or foreign matter adhered to the process unit 301 is removed and the process unit 301 is cleaned. In the case where the blocking member 91A is disposed at a projecting position X1 as with the case of the blocking member 91 in the first embodiment, the cleaning members 914A and 914B are disposed to substantially align with the blocking member 91A so that the cleaning members 914A and 914B do not block the optical path of laser light to be output through a seal glass 90A. The cleaning members 914A and 914B may be formed of a brush member, in place of a sponge member.

Figure 30:
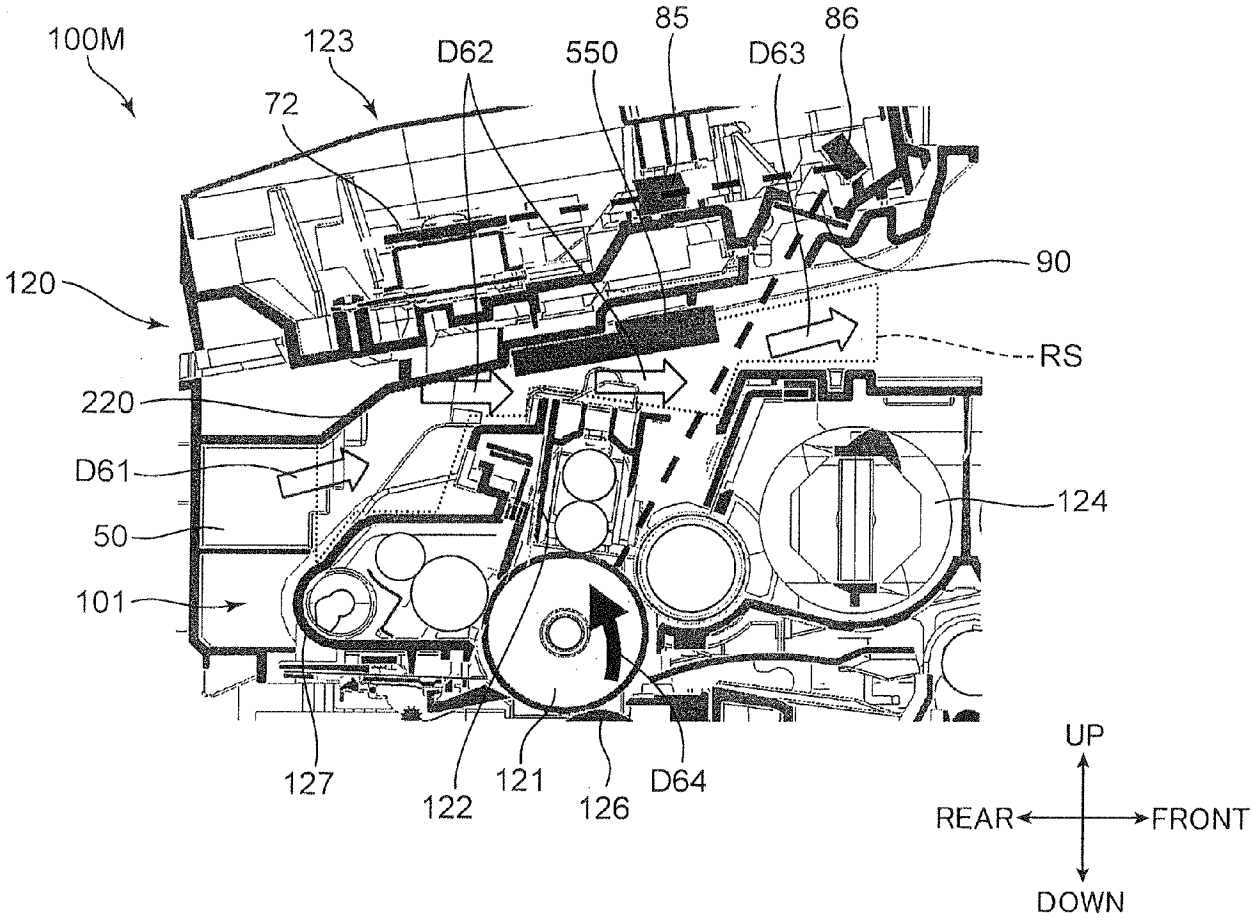
FIG. 30 is a cross sectional view showing the periphery of an image forming portion in an image forming apparatus according to a third embodiment of the present disclosure.

Next, a printer 100M (image forming apparatus) according to a third embodiment of the present disclosure is described. The third embodiment is different from the first embodiment in the configuration of an elastic guide member 550 (partition member). Accordingly, the third embodiment is described mainly on the above difference, and description on the same elements as those in the first embodiment will be omitted herein. FIG. 30 is a cross sectional view showing the periphery of an image forming portion 120 in the printer 100M according to this embodiment.

As shown in FIG. 30, in this embodiment, the elastic guide member 550 is disposed between an exposure device 123 and the image forming portion 120 (process unit 101). When the elastic guide member 550 is in a state (first state), in which the process unit 101 is mounted to a position (first position) facing a transfer roller 126 for image formation (for irradiating laser light transmitted through a seal glass 90 onto a photosensitive drum 121), the elastic guide member 550 is disposed between the exposure device 123 and a charger 122 in the process unit 101, and constitutes part of a cooling air path (first state). The elastic guide member 550 is fixedly mounted to a lower wall portion of an attachment plate 220 in such a manner as to project toward the process unit 101. The elastic guide member 550 is made of polyurethane foam, and is compressively (resiliently) deformable.

Disposing the elastic guide member 550 as described above makes it possible to guide and deflect an airflow flowing into the cooling air path 50 to flow away from the attachment plate 220 (in the direction of the arrow D62 in FIG. 30) by the elastic guide member 550, at a position above the charger 122, after having passed a position above a cleaning device 127 (in the direction of the arrow D61 in FIG. 30). Then, the airflow is guided forwardly of a developing device 124 (in the direction of the arrow D63 in FIG. 30), after having passed between the elastic guide member 550 and the developing device 124. As a result of the above operation, it is possible to prevent the airflow from approaching the seal glass 90. In other words, the elastic guide member 550 is configured to guide the airflow in such a direction as to be away from the seal glass 90.

In the case where the elastic guide member 550 is disposed to extend downwardly from the attachment plate 220 as with the case of the first embodiment, however, the elastic guide member 550 may obstruct the operation of mounting and dismounting the process unit 101. In particular, the aforementioned drawback is likely to occur in mounting and dismounting the process unit 101 in a direction orthogonal to the axis direction of the photosensitive drum 121. Further, during the mounting/dismounting operation, in the case where the process unit 101 is shifted to the second position closer to the exposure device 123 than the first position for preventing friction between the photosensitive drum 121 and the transfer roller 126, it is highly likely that the elastic guide member 550 as a partition wall of the cooling air path 50 may obstruct the operation of mounting and dismounting the process unit 101.

Figure 31:
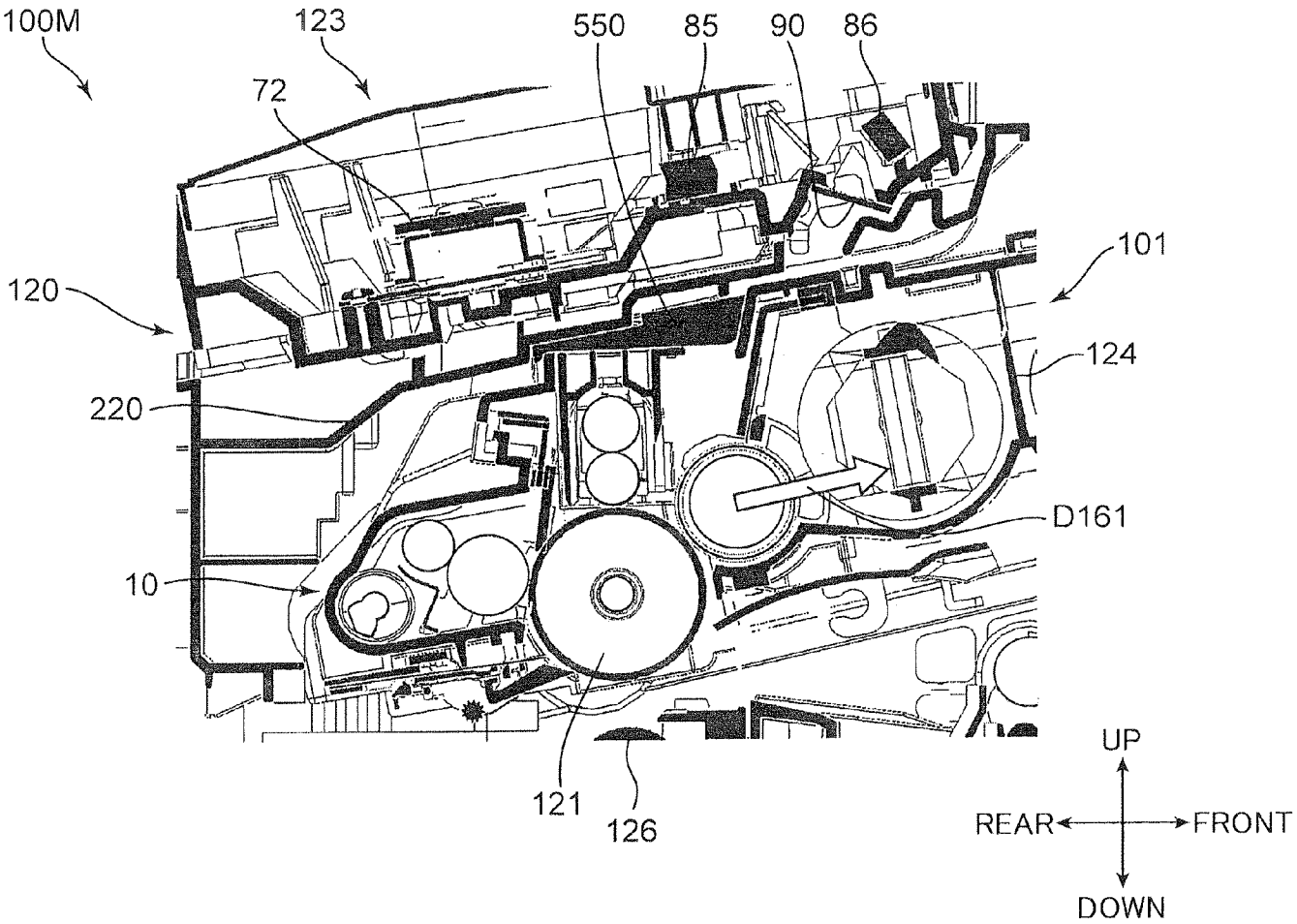
FIG. 31 is a cross sectional view showing a state that an image forming unit is moved upwardly in the image forming apparatus according to the third embodiment of the present disclosure.

As described above, however, the elastic guide member 550 in this embodiment is an elastic member made of an elastic material as represented by polyurethane foam. FIG. 31 is a cross sectional view showing a state of the elastic guide member 550 when the process unit 101 moves upwardly (see the direction of the arrow D64 in FIG. 30). In this embodiment, the elastic guide member 550 is compressively deformed by the process unit 101 disposed in the second position in the course of an operation of shifting the process unit 101 from the first position within a main body inner space 260 for dismounting the process unit 101 from the main body inner space 260. Thus, the elastic guide member 550 allows the process unit 101 to be shifted to the second position (second state of the elastic guide member 550). Accordingly, it is possible for the operator to take out the process unit 101 from the main body inner space 260 in the direction of the arrow D161 in FIG. 31. Further, when the process unit 101 leaves the elastic guide member 550 in a compressed state, the elastic guide member 550 is recovered to the original shape. The elastic guide member 550 is compressively deformable in the same manner as described above, in the case where the process unit 101 is mounted in the main body inner space 260.

As described above, in the third embodiment, as well as in the first and second embodiments, it is possible to guide an airflow generated by a cooling fan 500 between the exposure device 123 and the process unit 101 along the cooling air path 50. Thus, the process unit 101 is appropriately cooled, thereby preventing a drawback accompanied by a temperature rise of the process unit 101. In this embodiment, part of the cooling air path 50 is constituted of the elastic guide member 550 which is disposed between the exposure device 123 and the process unit 101, in which the process unit 101 is mounted to the first position within the main body inner space 260. The elastic guide member 550 is compressed by the process unit 101, in the course of an operation of shifting the process unit 101 from the first position within the main body inner space 260 for dismounting the process unit 101 from the main body inner space 260. Thus, the elastic guide member 550 allows the process unit 101 to be shifted (dismounted). Accordingly, there is no likelihood that the elastic guide member 550 may obstruct the operation of mounting and dismounting the process unit 101.

Further, in this embodiment, an airflow generated by the cooling fan 500 is deflected in such a direction as to be away from the seal glass 90 by the elastic guide member 550. Accordingly, it is possible to prevent the airflow from impinging on the seal glass 90, thereby preventing adhesion of toner or dust carried by the airflow onto the seal glass 90. As a result of the above operation, it is possible to form an electrostatic latent image on the photosensitive drum 121 by the exposure device 123 in a satisfactory manner.

Further, in this embodiment, the cooling air path 50 is defined by the attachment plate 220 and the outer wall of the process unit 101. Accordingly, it is possible to cool the outer wall of the process unit 101 in a satisfactory manner. Further, since the exposure device 123 is supported by the attachment plate 220, it is possible to stably maintain the positions of the optical components to be housed in the exposure device 123.

Further, the elastic guide member 550 is compressed by the outer wall of the charger 122. Specifically, the elastic guide member 550 is compressed by the outer wall portion of the process unit 101 which comes closest to the elastic guide member 550. In other words, it is possible to dispose the elastic guide member 550 at a position most proximal to the outer wall of the charger 122, when the elastic guide member 550 is in the first state.

The configurations of the printer 100 provided with the blocking member 91, the printer 100M provided with the blocking member 91A, and the printer 300 provided with the elastic guide member 550 according to the embodiments of the present disclosure are described as above. The present disclosure, however, is not limited to the above, but the following modifications may be applied, for instance.

In the first embodiment, the cooling air path 50 is defined by the lower wall portion of the attachment plate 220, and the upper outer wall of the process unit 101. The present disclosure, however, is not limited to the above. The cooling air path 50 may be defined by the lower outer wall (housing body 80G) of the exposure device 123, and the upper outer wall of the process unit 101. In the modification, it is possible to cool not only the process unit 101 but also the exposure device 123 by the airflow to be guided along the cooling air path 50 in a satisfactory manner. Accordingly, it is possible to prevent thermal deformation of the optical components in the exposure device 123.

Further, in the first embodiment, the blocking member 91 is disposed between the exposure device 123 and the charger 122 (at a position above the charger 122). The present disclosure, however, is not limited to the above. The blocking member 91 may be disposed in other region, for instance, at a position above the cleaning device 127.

Further, in the foregoing embodiments, the process unit 101 is integrally provided with the charger 122, the photosensitive drum 121, the developing device 124, the toner container 125, and the cleaning device 127. The present disclosure, however, is not limited to the above. The process unit 101 may be an image carrier unit provided with the photosensitive drum 121, the charger 122, and the cleaning device 127, or may be a unit provided with other constituent elements in the image forming portion 120.

Further, in the first embodiment, the position of the blocking member 91 is changeable between the projecting position X1 and the spaced position X2, as the blocking member 91 is pivotally moved about the axis of the shaft portion 910. The present disclosure, however, is not limited to the above. The blocking member 91 may be configured to slidably move between the process unit 101 and the exposure device 123.

Further, in the third embodiment, the elastic guide member 550 is made of polyurethane foam alone. The present disclosure, however, is not limited to the above. Alternatively, a thin PET film (sheet member) may be attached to the surface of the elastic guide member 550, for instance. In the modification, use of the PET film makes it possible to reduce friction between the process unit 101 and the elastic guide member 550. Accordingly, it is possible to prevent a likelihood that the friction between the elastic guide member 550 and the process unit 101 may obstruct an operation of mounting and dismounting the process unit 101 in shifting the process unit 101 in a state that the elastic guide member 550 is compressed.

Further, in the third embodiment, the cooling air path 50 is defined by the lower wall portion of the attachment plate 220 and the upper outer wall of the process unit 101. The present disclosure, however, is not limited to the above. The cooling air path 50 may be defined by the lower outer wall (housing body 80G) of the exposure device 123, and the upper outer wall of the process unit 101. In the modification, it is possible to cool not only the process unit 101 but also the exposure device 123 by the airflow to be guided along the cooling air path 50 in a satisfactory manner. Accordingly, it is possible to prevent thermal deformation of the optical components in the exposure device 123.

Further, in the third embodiment, the elastic guide member 550 is disposed between the exposure device 123 and the charger 122 (at a position above the charger 122), and is compressed by the outer wall of the charger 122. The present disclosure, however, is not limited to the above. The elastic guide member 550 may be disposed in other region, for instance, as at a position above the cleaning device 127.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

a casing provided with an inner space;

an opening/closing cover which is mounted on the casing to be openable and closable for opening the inner space to an outside of the image forming apparatus when the opening/closing cover is in an opened state;

an exposure device provided with a laser light source which emits laser light, a housing which houses the laser light source therein and includes an opening for passing the laser light therethrough, and a light transmissive member which is disposed in the housing at such a position as to cover the opening of the housing for transmitting the laser light, the exposure device being disposed in the inner space;

an image forming unit provided with an image carrier onto which the laser light transmitted through the light transmissive member is irradiated, the image forming unit being mounted to a first position facing the exposure device in the inner space, and being allowed to be mounted and dismounted to and from the inner space when the opening/closing cover is in the opened state;

an airflow generator which generates an airflow in the inner space;

a cooling air path which guides the airflow between the exposure device and the image forming unit in the inner space; and a partition member which is disposed between the exposure device and the image forming unit, and is configured to change a state thereof between a first state and a second state, the first state being such that the partition member projects toward the image forming unit mounted to the first position from a side of the exposure device, and constitutes part of the cooling air path when the opening/closing cover is in a closed state, the second state being such that the partition member allows the image forming unit to be dismounted from the inner space when the opening/closing cover is in an opened state, wherein the partition member is configured to be disposed at a projecting position at which the partition member projects toward the image forming unit mounted to the first position from the exposure device side when the partition member is in the first state, to be disposed at a spaced position away from the projecting position toward the exposure device side when the partition member is in the second state in, and to block the airflow from flowing toward the light transmissive member when the partition member is in the projecting position.

2. The image forming apparatus according to claim 1, wherein the image carrier carries an electrostatic latent image formed by the laser light, and a toner image corresponding to the electrostatic latent image thereon, the image forming apparatus further comprises a transfer portion which is allowed to come into contact with the image carrier when the image forming unit is mounted to the first position, on a side opposite to the exposure device with respect to the image carrier, for transferring the toner image from the image carrier onto a sheet, the image forming unit is configured to be shifted from the first position to a second position closer to the exposure device than the first position, and then to be dismounted from the inner space when the opening/closing cover is in an opened state, and the partition member disposed at the spaced position is disposed on the exposure device side with respect to the image forming unit in the second position.

3. The image forming apparatus according to claim 1, wherein the image forming unit includes:

a charger which is disposed between the image carrier and the exposure device for charging the image carrier;

a developing device which is disposed on a side opposite to the charger with respect to an optical path of the laser light toward the image carrier for supplying toner onto the image carrier; and a cleaning device which is disposed on a side opposite to the developing device with respect to the charger for collecting toner residues on the image carrier, wherein the cooling air path is configured to guide the airflow from the cleaning device toward the charger, and the partition member is disposed along the optical path of the laser light between the charger and the exposure device when the partition member is in the projecting position.

4. The image forming apparatus according to claim 1, wherein the partition member further includes a cleaning member which is configured to come into contact with the image forming unit to be dismounted from the inner space for cleaning a surface of the image forming unit when the partition member is in the spaced position.

5. An image forming apparatus, comprising:

a casing provided with an inner space;

an opening/closing cover which is mounted on the casing to be openable and closable for opening the inner space to an outside of the image forming apparatus when the opening/closing cover is in an opened state;

an exposure device provided with a laser light source which emits laser light, a housing which houses the laser light source therein and includes an opening for passing the laser light therethrough, and a light transmissive member which is disposed in the housing at such a position as to cover the opening of the housing for transmitting the laser light, the exposure device being disposed in the inner space;

an image forming unit provided with an image carrier onto which the laser light transmitted through the light transmissive member is irradiated, the image forming unit being mounted to a first position facing the exposure device in the inner space, and being allowed to be mounted and dismounted to and from the inner space when the opening/closing cover is in the opened state;

an airflow generator which generates an airflow in the inner space;

a cooling air path which guides the airflow between the exposure device and the image forming unit in the inner space;

a partition member disposed between the exposure device and the image forming unit and configured to change a state thereof between a first state and a second state, the first state being such that the partition member projects toward the image forming unit mounted to the first position from a side of the exposure device, and constitutes part of the cooling air path when the opening/closing cover is in a closed state, the second state being such that the partition member allows the image forming unit to be dismounted from the inner space when the opening/closing cover is in an opened state, the partition member being configured to be disposed at a projecting position at which the partition member projects toward the image forming unit mounted to the first position from the exposure device side when the partition member is in the first state and to be disposed at a spaced position away from the projecting position toward the exposure device side when the partition member is in the second state, and an interlocking portion configured to shift the partition member from the projecting position to the spaced position in association with an operation of shifting the opening/closing cover from a closed state to an opened state.

6. The image forming apparatus according to claim 5, wherein the partition member is provided with a rotating shaft which is rotatably supported on the casing, and a first extending portion which extends from the rotating shaft in a radial direction of rotation of the rotating shaft, the interlocking portion includes:

a projecting piece which radially projects from the rotating shaft at a position spaced away from the first extending portion by a certain distance in a circumferential direction of rotation of the rotating shaft; and an arm member which continues from the opening/closing cover, the arm member being configured to be spaced away from the projecting piece when the opening/closing cover is in an opened state, and being configured to come into contact with the projecting piece, as the opening/closing cover is shifted from the opened state to the closed state, wherein the partition member is configured to be disposed at the spaced position such that the first extending portion extends along a bottom surface of the exposure device when the opening/closing cover is in an opened state, and the partition member is configured to be pivotally moved about an axis of the rotating shaft by contact of the arm member with the projecting piece, as the opening/closing cover is shifted from the opened state to the closed state, and is configured to be disposed at the projecting position such that the first extending portion projects toward the image forming unit.

7. The image forming apparatus according to claim 6, wherein the partition member is disposed at the spaced position by a weight of the partition member when the arm member is spaced away from the projecting piece, as the opening/closing cover is shifted from the closed state to the opened state.

8. The image forming apparatus according to claim 6, wherein the partition member is further provided with a second extending portion which extends from the rotating shaft toward a side opposite to the first extending portion in the radial direction, the second extending portion is disposed to be away from an optical path of the laser light to be output through the light transmissive member when the partition member is in the projecting position, and the second extending portion is disposed at such a position as to block the optical path of the laser light when the partition member is in the spaced position.

9. An image forming apparatus, comprising:

a casing provided with an inner space;

an opening/closing cover which is mounted on the casing to be openable and closable for opening the inner space to an outside of the image forming apparatus when the opening/closing cover is in an opened state;

an exposure device provided with a laser light source which emits laser light, a housing which houses the laser light source therein and includes an opening for passing the laser light therethrough, and a light transmissive member which is disposed in the housing at such a position as to cover the opening of the housing for transmitting the laser light, the exposure device being disposed in the inner space;

an image forming unit provided with an image carrier onto which the laser light transmitted through the light transmissive member is irradiated, the image forming unit being mounted to a first position facing the exposure device in the inner space, and being allowed to be mounted and dismounted to and from the inner space when the opening/closing cover is in the opened state;

an airflow generator which generates an airflow in the inner space;

a cooling air path which guides the airflow between the exposure device and the image forming unit in the inner space; and a partition member which is disposed between the exposure device and the image forming unit, and is configured to change a state thereof between a first state and a second state, the first state being such that the partition member projects toward the image forming unit mounted to the first position from a side of the exposure device, and constitutes part of the cooling air path when the opening/closing cover is in a closed state, the second state being such that the partition member allows the image forming unit to be dismounted from the inner space when the opening/closing cover is in an opened state, wherein the partition member is formed of an elastic member, is disposed to project toward the image forming unit mounted to the first position from a side of the exposure device when the partition member is in the first state, and is configured to allow the image forming unit to be dismounted from the inner space while being compressed by the image forming unit when the partition member is in the second state.

10. The image forming apparatus according to claim 9, wherein the partition member is configured to guide the airflow in such a direction as to be away from the light transmissive member when the partition member is in the first state.

11. The image forming apparatus according to claim 9, wherein the image carrier carries an electrostatic latent image formed by the laser light, and a toner image corresponding to the electrostatic latent image thereon, the image forming apparatus further comprises a transfer portion which is configured to come into contact with the image carrier on a side opposite to the exposure device with respect to the image carrier for transferring the toner image from the image carrier onto a sheet, the image forming unit is configured to be shifted from the first position to a second position closer to the exposure device than the first position, and then to be dismounted from the inner space, and the elastic member is compressed by the image forming unit in the second position when the partition member is in the second state.

12. The image forming apparatus according to claim 9, further comprising:

a support frame which extends in the inner space and is configured to hold the exposure device, wherein the cooling air path is defined by the support frame and an outer wall of the image forming unit.

13. The image forming apparatus according to claim 9, wherein the cooling air path is defined by an outer wall of the exposure device and an outer wall of the image forming unit.

14. The image forming apparatus according to claim 9, further comprising:

a sheet member which is disposed on a surface of the partition member for reducing friction between the image forming unit and the partition member.

15. The image forming apparatus according to claim 9, wherein the image forming unit includes:

a charger which is disposed between the image carrier and the exposure device for charging the image carrier;

a developing device which is disposed on a side opposite to the charger with respect to an optical path of the laser light toward the image carrier for supplying toner onto the image carrier; and a cleaning device which is disposed on a side opposite to the developing device with respect to the charger for collecting toner residues on the image carrier, wherein the cooling air path is configured to guide the airflow from the cleaning device toward the charger, and the partition member is disposed between the charger and the exposure device when the partition member is in the first state.

16. The image forming apparatus according to claim 15, wherein the partition member is compressed by an outer wall of the charger of the image forming unit when the partition member is in the second state.

* * * * *